US007212093B2

(12) United States Patent
Singu et al.

(10) Patent No.: US 7,212,093 B2
(45) Date of Patent: May 1, 2007

(54) FERRITE CORE, METHOD OF MANUFACTURING THE SAME, AND COMMON-MODE NOISE FILTER USING THE SAME

(75) Inventors: Masamichi Singu, Yohkaichi (JP); Junichi Watari, Yohkaichi (JP)

(73) Assignee: Kyocera Corporation, Kyoto (JP)

( * ) Notice: Subject to any disclaimer, the term of this patent is extended or adjusted under 35 U.S.C. 154(b) by 126 days.

(21) Appl. No.: 10/897,966

(22) Filed: Jul. 22, 2004

(65) Prior Publication Data

US 2005/0052267 A1 Mar. 10, 2005

(30) Foreign Application Priority Data

Jul. 25, 2003 (JP) ..... 2003-202033
Oct. 28, 2003 (JP) ..... 2003-368012

(51) Int. Cl.
*H01F 27/02* (2006.01)

(52) U.S. Cl. ..... 336/83

(58) Field of Classification Search ..... 336/65, 336/83, 192, 200, 233; 29/602.1, 603.16
See application file for complete search history.

(56) References Cited

U.S. PATENT DOCUMENTS 6,472,969 B1 * 10/2002 Hanato ..... 336/192
6,727,792 B2 * 4/2004 Amada et al. ..... 336/192
6,965,289 B2 * 11/2005 Toi et al. ..... 336/83

FOREIGN PATENT DOCUMENTS

| | | |
|---|---|---|
| CN | 1251685 A | 4/2000 |
| JP | 11-204346 | 7/1999 |
| JP | 2002-329618 | 11/2002 |
| WO | WO98/35367 | 8/1998 |

* cited by examiner

*Primary Examiner*—Tuyen T. Nguyen
(74) *Attorney, Agent, or Firm*—Hogan & Hartson LLP

(57) ABSTRACT

The present invention provides a ferrite core which has a structure in that plating is prevented from elongating, which can maintain insulation resistance between electrodes and can prevent short-circuit between a conductor wire and the electrode without damaging adhesion properties while mounted and, moreover, which can stabilize a Q value (loss characteristic) of a product. The ferrite core includes a wound core and flanges integrally formed at both ends of the wound core, and each of the flanges includes a plurality of legs provided so as to rise from one surface of the wound core and having a top surface to be formed with electrode, and each leg is tapered off toward the top surface and an vertical corner portion formed between adjacent side faces thereof has a curved surface.

7 Claims, 13 Drawing Sheets

Fig.5A
Fig.5B
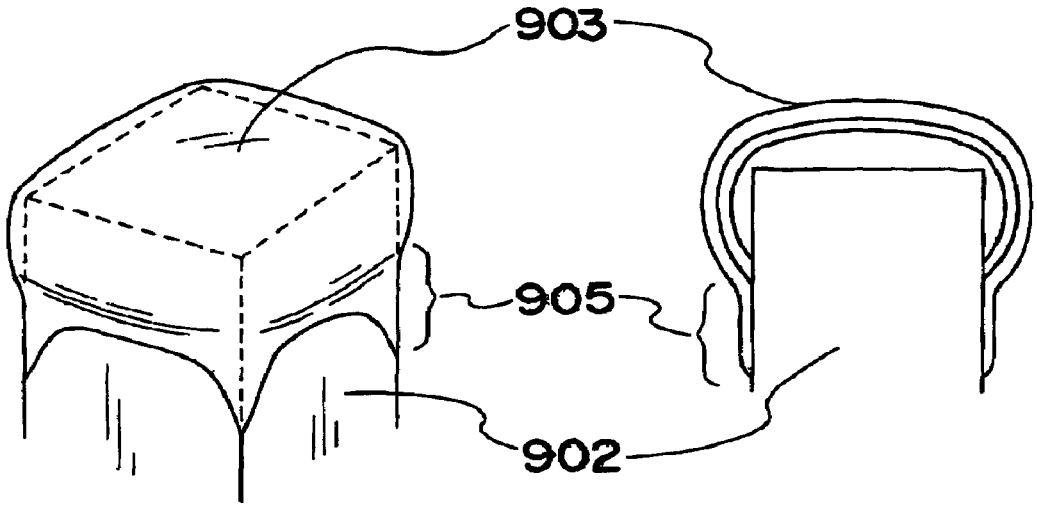
Fig.6
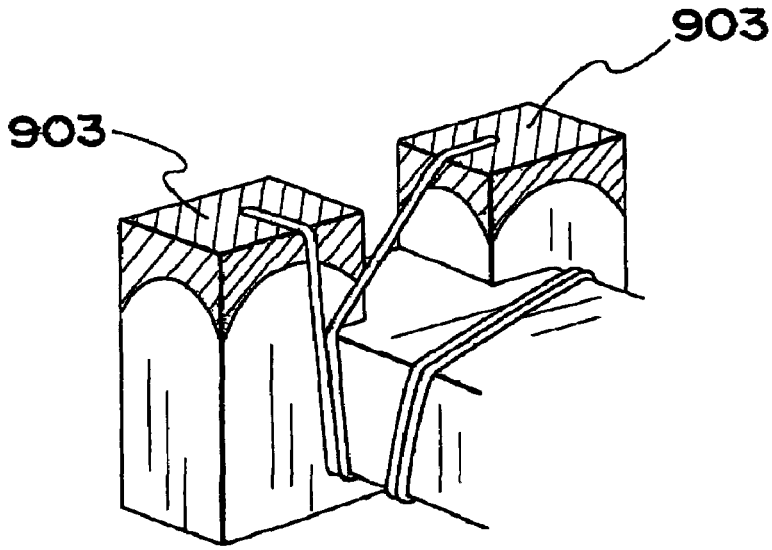

FERRITE CORE, METHOD OF MANUFACTURING THE SAME, AND COMMON-MODE NOISE FILTER USING THE SAME

BACKGROUND OF THE INVENTION

1. Field of the Invention

The present invention relates to a ferrite core suitable for measures for common-mode noise of various kinds of electronic devices in which a high-frequency signal is used, its manufacturing method, and a common-mode noise filter used in a differential transmission circuit and the like.

2. Description of the Related Art

A common-mode noise filter is used for measures for unnecessary radiation of a power supply line or measures for a common-mode noise of a high-frequency signal.

The common-mode noise filter is constituted such that a plurality of conductor wires are wound around a ferrite core 906 by several turns to some dozen turns. According to the conventional example disclosed in JP-A 2002-329618, as shown in FIGS. 3A–3C, the ferrite core 906 includes a ferrite porcelain having a wound core 904, flanges 901 provided at both ends thereof, and a plurality of legs 902 continued to the flanges 901, and electrodes 903 are formed on top surfaces of the respective legs 902. According to the conventional example shown in FIGS. 3A–3C, the plurality of conductor wires are wound around the wound core 904 of the ferrite core 906 constituted as described above by several turns to some dozen turns, and starting ends of the conductor wires are connected to the electrodes 903 on the top surfaces of the legs 902 by soldering, thermo-compression or the like, and finishing ends thereof are connected to the electrodes 903 on the top surfaces of other legs 902 by soldering, thermo-compression or the like.

According to this conventional example, the electrode 903 is constituted such that a paste for a thick film conductor such as Ag, AgPd and the like is applied to respective top surfaces of the legs 902 by a method such as dipping, screen printing, transferring or the like and burned, and several layers formed of Ni or Cu, Sn, SnPb, Au and the like are formed on the thick film conductor depending on usage or requests.

The plated film is formed on the thick film conductor by dipping a ferrite porcelain on which the thick film conductor is formed, into a plating solution containing predetermine metal and applying a current. In addition, after the plated film is formed, the plating solution attached onto the ferrite porcelain is rinsed out to be removed.

According to the thus constituted common-mode noise filter, when a common-phase current is applied to two conductor wires, a magnetic flux is reinforced and impedance is increased. Meanwhile, when a reversed-phase current is applied to the two conductor wires, the magnetic flux is negated and impedance is decreased. Thus, the common-mode noise filter is an electronic component having a filter function in which the common-phase current flows little but the reversed-phase current flows well.

In addition, in a field of information communication devices in which the common-mode noise filter is used, there are demands for smaller and lighter components. According to the demands, an almost rectangular size of the area when mounted becomes gradually smaller, that is, from 3216 type in which the size is 3.2 mm by 1.6 mm, to 2520 type in which the size is 2.5 mm by 2.0 mm and further to 2012 type, 1608 type and 1210 type.

In addition, as shown in FIGS. 3A–3C, JP-A 2002-329618 discloses that all boundary parts between the top surfaces and side faces of each leg 902 in the ferrite core 906 have curved surfaces.

In addition, a curvature radius of the curved surface body of the leg 902 is 0.2 to 0.3 mm and the side faces of the four legs 902 on the side of the wound core 904 are inclined surfaces 908 inclined from the upright direction by 30 to 70°.

According to the above, since the boundary part between the top surface and the side face of the leg 902 has the curved surface whose curvature radius is about 0.2 mm, it is assumed that breaking or short-circuit of the conductor wire at this boundary part can be prevented. Furthermore, since the side face of the leg 902 on the side of the wound core 904 has the inclined surface 908, the conductor wire wound around the wound core 904 by bifilar winding can be connected to the electrode 903 at a gentle angle. As a result, it is shown that there can be provided the common-mode noise filter having higher reliability.

According to the ferrite core according to a second conventional example disclosed in Japanese Patent No. 3168972, as shown in FIGS. 15A, 15B and 15C, an inclined surface is formed at a leg 952.

According to the second conventional example, it is assumed that since a conductor wire 957 can have a necessary distance because of the inclined surface, a short-circuit, pressure deterioration and the like caused when an electrode 954 of the leg 952 to be connected comes into contact with an electrode 954 of the adjacent leg 952 can be sure prevented.

In addition, it is assumed that when the conductor wire 957 is mounted along the inclined surface, since a connection angle of the conductor wire 957 can be gentle, the conductor wire 957 can be prevented from breaking so that there is provided a common-mode noise filter having higher reliability.

However, in the filed of information communication devices in which such common-mode noise filter is used, there are demands for further smaller and lighter components in accordance with miniaturization of the device. As a result, according to a wiring type of common-mode noise filter, its almost rectangular size when mounted is gradually miniaturized from a size of 3.2 mm by 1.6 mm to a size of 2.5 mm by 2.0 mm, 2.0 mm by 1.2 mm, 1.6 mm by 0.8 mm, and 1.2 mm by 1.0 mm.

Under such circumstances, the common-mode noise filter using the ferrite core disclosed in JP-A 2002-329618 has the following problems.

That is, when the electrode 903 is formed on the top surface of the leg 902, there is a problem such that the plating elongates along a boundary part (vertical corner portion) between the side faces of the leg.

When the plating elongates along the vertical corner portion, it becomes difficult to acquire insulating properties as the component becomes smaller. That is, as shown in FIGS. 4 and 5, when the electrode 903 is formed on the top surface of the leg 902, the plated layer is liable to elongate along the edge line of the leg and it becomes difficult to acquire insulating properties.

According to a structure of the conventional common-mode noise filter, in the case of the size of 3.2 mm by 1.6 mm, for example, even when the plating of the electrode 903 elongates as described above, since the distance between electrodes 903 of the legs 902 is kept at about 0.6 mm, insulating properties can be remained, but when the size becomes smaller, it becomes difficult to acquire the insulating properties.

In addition, although it is preferable to increase the thickness of the electrode 903 in order to acquire mounting strength when the common-mode filter is mounted on a substrate, since the plating elongates along the vertical corner portion in the conventional structure, there is a limitation in forming thickly the plate layer and it is difficult to sufficiently acquire the mounting strength. That is, the plating elongates well as the thickness of the plating is increased.

Furthermore, as shown in FIG. 6, there is a problem such that the conductor wire connected to one electrode 903 of the adjacent legs comes in contact with the plated layer elongated along the vertical corner portion of the other leg to cause a short-circuit.

Furthermore, since the dimensions of the electrodes 903 vary because of the elongation of the plating, there is a problem such that loss of a magnetic flux generated at the ferrite core 6 varies and a Q value (loss characteristic) is liable to vary.

Still further, according to the common-mode noise filter using the ferrite core disclosed in Japanese Patent No. 3168972, there is a problem such that the area of the top surface of the leg 952 is decreased because the inclined surface is provided at the leg 952, so that adhesion strength when mounted is lowered.

SUMMARY OF THE INVENTION

The present invention is made to solve the above problems and it is an object of the present invention to provide a ferrite core and a common-mode filter each of which has a structure in that plating is prevented from elongating, which can maintain insulation resistance between electrodes and can prevent short-circuit between a conductor wire and the electrode without damaging adhesion properties while mounted and, moreover, which can stabilize a Q value (loss characteristic) of a product.

A first ferrite core according to the present invention includes a wound core and flanges integrally formed at both ends of said wound core. Each of the flanges includes a plurality of legs formed so as to rise from one surface of said wound core and each of said legs has a top surface to be formed with electrode. In order to attain the above object, the first ferrite core is characterized in that each of the legs is tapered off toward the top surface and each of corner portions between adjacent side faces of the legs is a curved surface.

According to the ferrite core of the present invention, a curvature radius of the edge line of each leg is preferably set in a range of 0.02 to 0.2 mm.

In addition, according to the ferrite core of the present invention, it is preferable that a curvature radius of the edge line of each leg is gradually increased toward the top surface so that the curvature radius is set in a range of 0.02 to 0.15 mm on the side of the one surface and the curvature radius is set in a range of 0.05 to 0.2 mm on the side of the top surface.

According to the first ferrite core of the present invention, since the plating is prevented from elongating along the corner portion when the electrode is formed, insulation between the electrodes can be maintained at a high level.

Therefore, according to the ferrite core of the present invention, the common-mode noise filter can be further miniaturized while the high reliability of insulation between the electrodes is maintained.

In addition, according to the ferrite core of the present invention, since the plating is prevented from undesired elongating when the electrode is formed, the conductor wire can be prevented from coming into contact with the electrode of the leg, which are to be insulated from each other.

Furthermore, according to the ferrite core of the present invention, since the plating is prevented from undesired elongating when the electrode is formed and unnecessary part is not covered with the electrode, the higher Q value of the product can be provided and its variation can be suppressed.

Still further, since a necessary thickness can be provided while the plating is prevented from undesired elongating, mounting strength when mounted on the substrate can be enhanced.

In addition, according to a method of manufacturing a ferrite core of the present invention, a ferrite core includes a wound core and flanges which are integrally formed at both ends of the wound core and each of which includes a plurality of legs, which rise from one surface of the wound core and have top surfaces to be formed with electrode, is manufactured so that each corner portion of the legs has a curved surface. The method is characterized in comprising a step of chamfering corner portions of each of the legs so as to have a curved surface by processing a sintered body which is an original form of the ferrite core by a barreling process.

According to the method of manufacturing the ferrite core of the present invention, water can be used in the barreling process.

According to the method of manufacturing the ferrite core of the present invention, a polishing agent having resistance of $10^5$ Ω·cm or more may be used in the barreling process.

According to the manufacturing method of the ferrite core of the present invention, the curved surface shape, a curved dimension, and surface roughness can be easily and freely adjusted by the barreling process even in a small-sized ferrite core.

Still further, since the polishing agent of high resistance is used or only water is used in the barreling process, even when small particles of the polishing agent are attached to the sintered body which becomes the ferrite porcelain, the plating can be prevented from elongating because a current is not liable to flow between the small particles of the polishing agent attached onto the surface and the thick film conductor which becomes the electrode when plating is performed to form the electrode in the subsequent process.

In addition, according to a first common-mode noise filter of the present invention, a conductor wire is wound around the first ferrite core of the present invention.

As described above, since the first common-mode noise filter of the present invention is constituted with the first ferrite core according to the present invention, even when the common-mode noise filter is miniaturized and the distance between the adjacent electrodes becomes small, reliability of the insulation resistance between electrodes can be maintained at a high level. As a result, the short-circuit between the electrode and the conductor wire is prevented, the higher Q value can be obtained and a small variation can be obtained.

A second ferrite core of the present invention includes a wound core and flanges integrally formed at both ends of the wound core, each of said flanges including a plurality of legs formed so as to rise from one surface of said wound core. The second ferrite core is characterized in that a projection length of at least one leg of the plurality of legs toward the wound core is different from a projection length of another leg toward the wound core in the flange.

As described above, according to the second ferrite core of the present invention, since a distance more than desired value can be provided between at least one leg and the conductor wire connected to the electrode of the leg other than the above leg, the short-circuit or deterioration caused when the conductor wire and the electrode which are to be insulated comes in contact with each other can be prevented.

In addition, the leg other than at least one leg can be set at a necessary size and the bonding strength when mounted can be stably provided.

According to the ferrite core of the present invention, it is preferable that a projection length of the leg positioned dose to one side face the wound core is longer than a projection length of the leg positioned close to the other side face, in one flange of the two flanges, and a projection length of the leg positioned dose to the one side face is shorter than a projection length of the leg positioned close to the other side face, in the other flange of the two flanges.

Furthermore, according to the present invention, when there are three or more legs in each flange, it is preferable that the projection lengths increase gradually with coming close to the one side face in the one flange, and the projection lengths decrease gradually with coming close to the one side face in the other flange.

In addition, according to the present invention, a length of at least one leg in the axis direction of the wound core may be different from that of another leg.

Furthermore, according to the ferrite core of the present invention, each leg has a transverse sectional shape in which an aspect ratio of a long axis to a short axis is 1 or more, and each projection length may be set by adjusting an angle between the long axis and the axis direction of the wound core.

According to the above ferrite core, it is preferable that an angle between the long axis and the axis direction of the wound core is gradually increased or decreased toward the other side face or the one side face.

In addition, according to the above ferrite core, it is preferable that the long axis of the leg positioned dose to one side face of two side faces positioned on both sides of the one surface of the wound core crosses the axis direction of the wound core at right angles in one flange of the two flanges, and the long axis of the leg positioned close to the one side face is parallel to the axis direction of the wound core in the other flange of the two flanges.

Furthermore, according to the present invention, the legs may have the same shapes or different shapes.

Besides, according to the ferrite core of the present invention, it is preferable that a transverse sectional shape of the leg is the same from the side of the wound core to the side of the top surface.

Still further a third ferrite core of the present invention includes a wound core, and flanges integrally formed at both ends of the wound core, in which each of the flanges includes a plurality of legs provided so as to rise from one surface of the wound core, and outer two legs in each flange are provided so as to project from both side faces of the one surface.

As described above, according to the third ferrite core of the present invention, since the desired distance is provided between the conductor wire and the leg, which are to be insulated from each other, the short-circuit or deterioration between the conductor wire and the electrode of the leg caused when the conductor wire comes into contact with the electrode can be prevented.

According to the third ferrite core of the present invention, a distance between the outer two legs in each flange may be equal to a width of the wound core, or may be longer than a width of the wound core.

In addition, according to the third ferrite core of the present invention, another leg may be provided between the outer two legs in each flange and the projection length of the leg toward the wound core may be shorter than the projection lengths of the two outer legs toward the wound core.

Still farther, the distance can be provided between the conductor wire and the leg by making the inner leg smaller than legs on both sides, so that the short-circuit or deterioration between the conductor wire and the electrode of the leg caused when the conductor wire comes into contact with the electrode can be prevented.

In addition, according a second common-mode noise filter of the present invention, a conductor wire is wound around the third ferrite core according to the present invention.

BRIEF DESCRIPTION OF THE DRAWINGS

FIG. 5A is a perspective view for describing problems of the conventional ferrite core;

FIG. 5B is a sectional view for describing problems of the conventional ferrite core;

FIG. 6 is a partially perspective view for describing problems of the conventional ferrite core;

DESCRIPTION OF THE PREFERRED EMBODIMENTS

Hereinafter, embodiments of a ferrite core according to the present invention are described with reference to the drawings.

First Embodiment

Figure 1A:
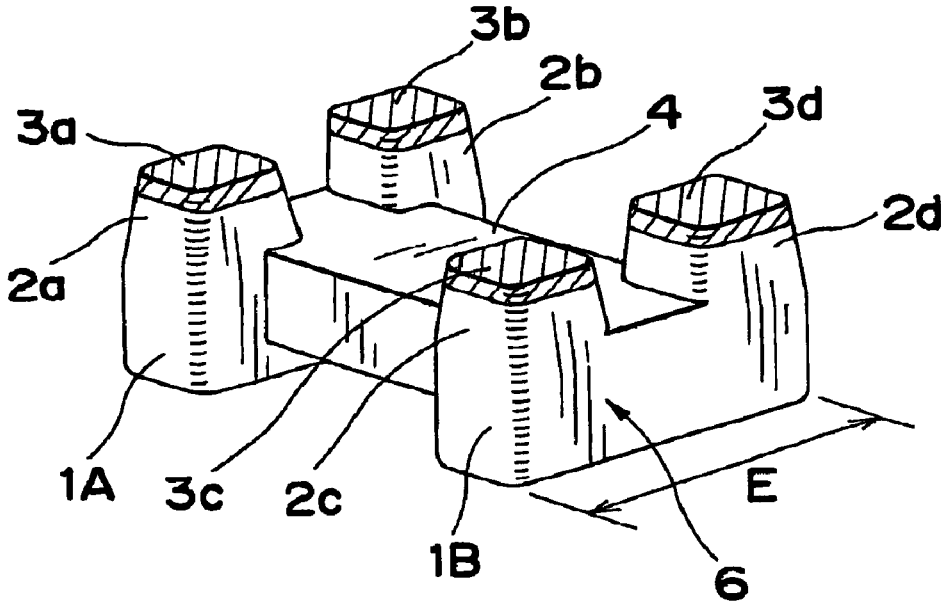
FIGS. 1A and 1B are perspective views showing a ferrite core according to a first embodiment of the present invention.
Figure 1B:
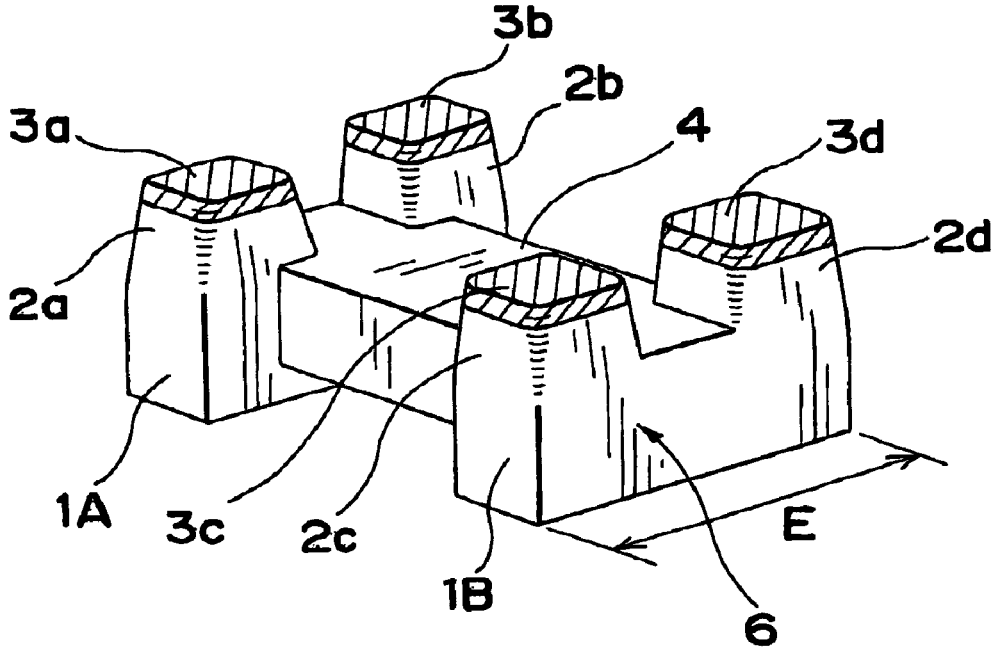

FIGS. 1A and 1B are perspective views each showing a constitution of a ferrite core 6 according to a first embodiment of the present invention. In FIGS. 1A and 1B, the ferrite core 6 is shown with the bottom side up.

A ferrite porcelain constituting the ferrite core 6 is formed of a magnetic material such as Ni—Zn ferrite, Mn—Zn ferrite or the like and the ferrite core 6 includes flanges 1A and 1B at both ends of a wound core 4. In addition, legs 2*a* and 2*b* are formed at the flange 1A and legs 2*c* and 2*d* are formed at the flange 1B. In addition, electrodes 3*a*, 3*b*, 3*c* and 3*d* are formed on the top surfaces of the legs 2*a*, 2*b*, 2*c* and 2*d*, respectively.

For example, according to the ferrite core called 2012 size, since its short-side dimension E is 1.2 mm, a distance between two legs 2 formed at the flange 1 is very small such as approximately 0.4 mm in view of breaking strength of the legs and short-circuit protection of a highly viscous paste used at the time of printing of a thick film conductor.

Here, according to the ferrite core 6 of the present invention, it 18 important that each leg 2 is tapered off toward the top surface and corner portions (edge line portions) between the side faces of the leg 2 has a curved surface as shown in FIG. 1A.

Figure 3A:
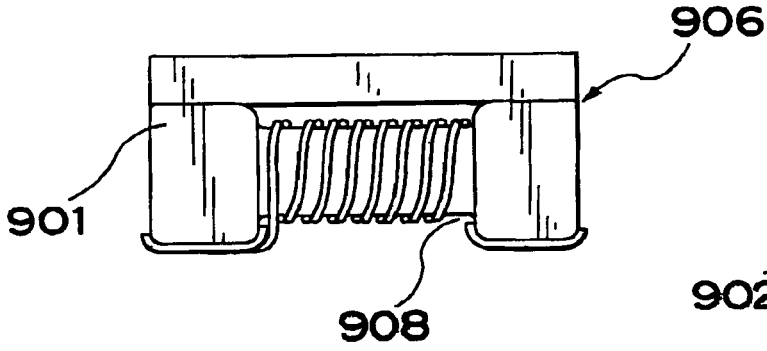
FIG. 3A is a side view showing a common-mode noise filter using a conventional ferrite core.
Figure 3B:
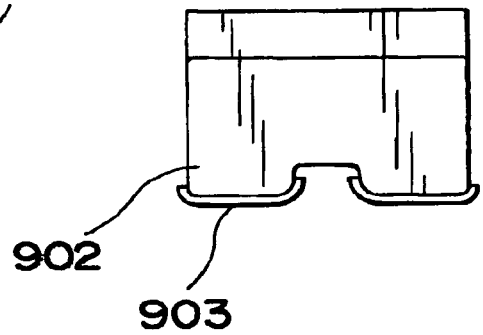
FIG. 3B is an end view showing the common-mode noise filter using the conventional ferrite core.
Figure 3C:
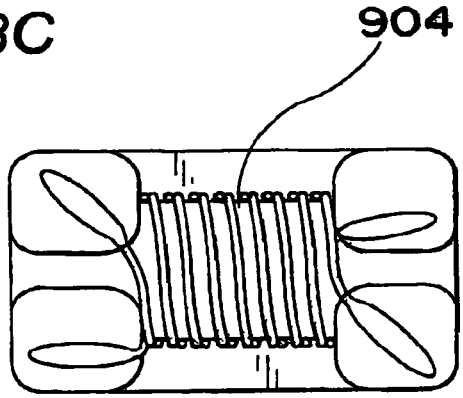
FIG. 3C is a plan view showing the common-mode noise filter using the conventional ferrite core taken from the side of a top surface thereof.
Figure 4:
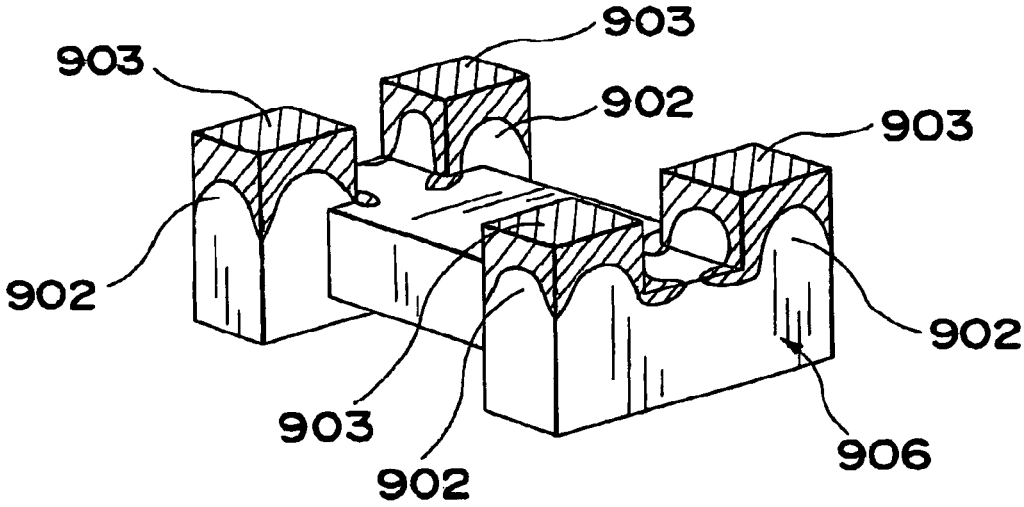
FIG. 4 is a perspective view for describing problems of the conventional ferrite core.

According to a conventional ferrite core 906 shown in FIG. 3, an edge line (referred to as a lateral edge line, hereinafter) constituted by the top surface and side face of the leg 902 has a curved surface. Meanwhile, according to the first embodiment, the vertical corner portions (portions along with vertical edge lines) constituted by the adjacent side faces of the leg has the curved surface.

According to the first embodiment, since the vertical corner portion has the curved surface, a plated film can be prevented from elongating along the vertical corner portion at the time of electric field plating when the electrode 3 is formed at the leg 2, and a short-circuit between the electrodes 3 can be prevented even in the small-sized ferrite core 6 in which the distance between the legs 2 is small. In addition, since the leg 2 is tapered off toward the top surface, the area of the top surface of the leg 2 can be small, so that electric charges can effectively converge at a thick film conductor formed on the top surface of the leg 2 at the time of electric field plating and plating can be surely prevented from elongating along the vertical corner portion.

Conventionally, the reason why the plating elongates has been considered such that the component of the ferrite porcelain itself acts to trigger it. However, since the plating elongates larger at the edge line between the side faces of the leg 2, the inventors of the present invention have considered that it happens because electric charges converge at the vertical corner portion at the time of electric field plating and completed the present invention in which the leg is tapered off and the vertical corner portion has a curved surface.

More specifically, since electric charges have characteristics in which they are liable to converge at a corner part at the time of electric field plating, according to the conventional example, the lateral edge line of each leg 902 has a curved surface, but the plating cannot be effectively prevented from generating at the vertical corner portion. In addition, since the electric charges are not liable to converge at a flat part of an electrode 903, the plating is not liable to be formed at the flat part of the electrode 903, so that the dispersed electric charges are liable to converge at the top surface and its vicinity which are curved. As a result, the plating further tends to elongate at the vertical corner portion.

Meanwhile, according to the first embodiment of the present invention, since the leg 2 is tapered off, the electric charges can effectively converge at the thick film conductor formed on the top surface of the leg 2 and since the vertical corner portion has the curved surface, the electric charges are prevented from converging at the vertical corner portion and the plating is prevented from elongating there at the time of plating.

Therefore, according to the present invention, since an unnecessary electrode is not formed at the side faces and vertical corner portions of the leg 2, insulation resistance between adjacent electrodes 3*a* and 3*b*, and adjacent electrodes 3*c* and 3*d* can be substantially high and a short-circuit between a conductor wire and the electrode 3 which need to be electrically separated can be prevented.

In addition, even when the ferrite core is farther miniaturized, since the plating is prevented from elongating, insulating properties can be easily maintained.

In addition, according to the first embodiment of the present invention, since the leg 2 is tapered off, the electric charges can effectively converge at the thick film conductor formed on the top surface of the leg 2, so that the plating can be thickly formed on the top surface and mounting strength when mounted on a substrate can be enhanced.

Besides, according to the conventional ferrite core, since a dimension of the electrode 903 varies because the plating elongates, there is a problem such that a loss of a magnetic flux generating at the ferrite core 6 varies, so that a Q value (loss characteristic) is liable to vary.

That is, since the electrode 3 is a conductor, a loss of a high-frequency signal is great as compared with the ferrite porcelain which is a high resistance, so that variation of the electrode area causes the loss of the high-frequency signal to vary.

However, according to the present invention, since the leg 2 is tapered off and the vertical corner portion has the curved surface, the plating is prevented from elongating. As a result, the area of the electrode 3 can be prevented from varying and the Q value of a product can be kept stable.

Hereinafter, a detailed description is made of the tapered shape of the leg 2 in order to obtain the above effects.

According to the present invention, an area of the top surface of the leg 2 at the end is preferably 50 to 85% of a sectional area at the root of the leg 2 (a sectional area at a boundary part with the wound core), so that electric charges may effectively converge at the thick film conductor formed on the top surface.

When the area ratio is less than 50%, the electrode 3 becomes small and the mounting strength is lowered. Meanwhile, when it exceeds 85%, it is difficult for the electric charges to converge at the thick film conductor formed on the top surface of the leg 2 and then the plating is not prevented from elongating.

In addition, a curvature radius of the vertical corner portion of the leg 2 is preferably 0.02 to 0.2 mm. Thus, the electric charges are prevented from converging at the vertical line and can converge at the thick film conductor of the electrode 3, so that the plating can be prevented from elongating. When the curvature radius of the leg 2 is less than 0.02 mm, the electric charges cannot be prevented from converging at the vertical corner portion so that the plating cannot be prevented from elongating. In addition, the vertical corner portion is liable to be chipped. Alternatively, when the curvature radius of the leg is larger than 0.2 mm, since the leg 2 becomes thin, the strength is lowered. The curvature radius is more preferably 0.05 to 0.15 mm.

In addition, as shown in FIG. 1B, it is further preferable that the curvature radius of the vertical corner portion of the leg 2 is 0.02 to 0.15 mm on the side of the flange 1 and is 0.05 to 0.2 mm on the side of the top surface so as to be gradually increased.

Thus, when the curvature radius on the side of the top surface of the leg 2 is larger than the curvature radius on the side of the flange 1, the plating can be more effectively prevented from elongating when the electrode 3 is formed. Besides, the strength of the leg 2 can be retained by decreasing the curvature radius on the side of the flange 1.

That is, since an elongation of the plating during forming the electrode 3 grows from an upper end of the thick film conductor along the vertical corner portion of the leg 2, the curvature radius of the corner portion is preferably larger on the side of the top surface which is the side of the thick film conductor. Meanwhile, in order to keep the strength as much as possible, it is necessary to largely keep the sectional area of the leg 2 on the near side of the flange 1 which less affects on the growing of the plating, so that its curvature radius is preferably small.

Here, when the curvature radius on the side of the flange 1 of the leg 2 is smaller than 0.02 mm, the corner portion is liable to be chipped. Meanwhile, when the curvature radius is larger than 0.2 mm, since the leg 2 becomes thin, the strength is lowered. When the curvature radius on the side of the top surface is smaller than 0.05 mm, it is difficult to prevent the plating from elongating and insulating properties cannot be retained. Meanwhile, when the curvature radius is larger than 0.2 mm, since the leg 2 becomes thin, the strength is lowered and the mounting strength is also lowered because the electrode 3 becomes small.

In addition, when the curvature radius of the vertical corner portion of the leg 2 is 0.02 to 0.15 mm on the side of the flange 1 and 0.05 to 0.2 mm on the side of the top surface and it is gradually increased toward the top surface, the leg 2 is tapered off, so that the electric charges can easily converge at the thick film conductor when a plated layer is formed on the thick film conductor formed on the electrode 3 by the electric field plating. As a result, the plating can be effectively performed, the electric charges are prevented from being dispersed to a part other than the thick film conductor and the plating is prevented from elongating.

For example, in a case of a ferrite core for a common-mode filter of 2012 size, since the leg 2 is about 0.4 mm square, the curvature radius is preferably 0.02 to 0.07 mm on the side of the flange 1 and 0.05 to 0.1 mm on the side of the top surface.

Next, description will be given of a manufacturing method of the ferrite core 6 according to the present invention.

Raw powder is provided by adding a predetermined binder to powder such as Ni—Zn ferrite or Mn—Zn ferrite which is a raw material of the ferrite porcelain and forming granule suitable for powder molding by spray drying or the like. As the raw material, Ni—Zn ferrite is preferable in view of a frequency used and a surface resistance value.

Then, the raw powder is put in a die of a desired shape and pressed by a predetermined pressure to provide a molded body for the ferrite porcelain.

Then, the molded body is burned at a predetermined temperature in a furnace such as an electric furnace or a gas furnace and sintered to provide a sintered body which is an original shape of the ferrite porcelain. The vertical corner portion of the leg 2 of the sintered body does not have the curved surface at this stage and the sectional shape from the side of the flange to the side of the top surface is the same.

Then, processing is performed such that the leg 2 of the sintered body may be tapered off and the vertical corner portion may have the curved surface.

As a method of tapering off the leg 2, although there are a mechanical process, a blasting process and a barreling process, the barreling process is preferable among them especially.

According to the ferrite core 6 of the present invention, when the processing is performed such that the leg 2 of the sintered body may be tapered off and the vertical corner portion between the side faces of the leg 2 may have the curved surface, since the mechanical process has to be performed on each sintered body separately, cost becomes too high. In addition, according to the blasting process, since a polishing agent is applied to the entire surface and polishing power is too high, the surface unnecessarily gets rough so that the strength of the sintered body is liable to be lowered. Meanwhile, according to the barreling process, since the sintered body, water, a polishing agent and the like are put in a pot made of porcelain and rotated, batch processing is possible so that its processing cost can be low. In addition, according to the barreling process, even when the processing is performed with the polishing agent or even when the processing is performed by only frictional force with water only, since the polishing process is performed in water in either case, the surface of the sintered body does not unnecessarily get rough and it can keep a necessary strength after the barreling process. Furthermore, according to the barreling process, since the sintered body impinges on the polishing agent or the sintered bodies impinge on each other, the corner portion, a projection and a tip end of the projection which are most likely to impinge are processed by the barreling process more than other parts, so that the barreling process is especially suitable for the process in which the curvature radius of the vertical corner portion of the leg is gradually increased toward the top surface.

As a polishing material used in the barreling process, a high-resistance polishing agent is preferable, or it is preferable that the sintered bodies are processed by contacts with each other using only water without using the polishing agent.

The high-resistance polishing material is a polishing agent whose resistance value is not less than $10^5$ Ω·cm and alumina, silica and the like can be used for that. Thus, even if small particles of the polishing agent are attached on the sintered body which becomes the ferrite porcelain after the barreling process, since a current flows little between the polishing agent of the small particles attached on the surface and the hick film conductor at the time of electric field plating for forming the electrode 3 in the subsequent process, the plating does not elongate easily.

The resistance value is preferably not less than $10^{11}$ Ω·cm mainly because it is the same as that of the Ni—Zn ferrite material used as the ferrite porcelain. Meanwhile, in a case the polishing agent whose resistance value is lower than $10^5$ Ω·cm is used, when the small particles are attached on the sintered body which will be the ferrite porcelain after the barreling process, since a current flows between the polishing agent of the small particles attached on the surface and the thick film conductor at the time of electric field plating for forming the electrode 3 in the subsequent process, the plating is liable to elongate and insulating properties cannot be retained.

In addition, the resistance value of the polishing agent is measured by a high-resistance measuring device produced by HP Co. such that a DC voltage of 50 V is applied to the polishing agent which was put in an insulating mold, pressed and hardened.

In addition, a particle diameter of the polishing agent is preferably not more than 400 μm. When the polishing agent having the particle diameter 400 μm or less is used, the polishing agent substantially intrudes between the legs 2, and the vertical corner portion of the leg 2 can be formed into a curved surface. Meanwhile, when it exceeds 400 μm, since the polishing agent does not impinge between the legs 2, the vertical corner portion on the inner side face of the leg 2 cannot be curved.

The curvature radius of the vertical corner portion in the barreling process is adjusted by the number of sintered bodies to put in the pot-shaped container made of porcelain, an amount of polishing agent, and a processing time. If the number of sintered bodies is large, since the polishing force is increased, a large curvature radius can be easily provided and especially, the curvature radius of the corner portion, the projection and the tip end of the projection become larger easily than the other parts. If a large amounts of polishing agent is put in, since the sintered bodies less impinge on each other and they are more polished by the polishing agent, the curvature radius is liable to become uniform. If the processing time is increased, the curvature radius becomes large in either case.

As a condition of the barreling process, the sintered bodies are 1 to 6 litters and water is 4 to 9 litters in the barrel capacity of 13 litters, for example, and the particle diameter and the amount of the media (polishing agent) are adjusted depending on the size of the product and desired shape of the curved surface.

When the sintered bodies are processed by contacts with each other using only water without using the polishing agent, the predetermined shape of the curved surface can be formed by adjusting the number of sintered bodies and the processing time.

Still further, surface roughness of the sintered body of the ferrite porcelain in which the electrode 3 is formed at the leg 2 is preferably Ra0.2 to 0.6 μm. When the surface roughness is smaller than Ra0.2 μm, the thick film conductor printed at the leg 2 is easily peeled off and adhesion strength when mounted as the product is lowered. Meanwhile, when the surface roughness is larger than 0.6 μm, the surface becomes rough and the strength is lowered. Here, a measuring method of the surface roughness is such that the ferrite porcelain is fixed on a flat plate with the leg side up and the top surface of the leg 2 on which the thick film conductor is printed is touched by a sensing pin of a measuring device. Ra is adjusted by the number of revolution speed of the pot made porcelain and the like at the time of barreling process. When the revolution speed of the pot is high, since the sintered bodies impinge on each other or the sintered body impinges on the polishing agent strongly, Ra is increased. When the revolution speed is lowered, the sintered bodies impinge on each other or the sintered body impinges on the polishing agent weakly, Ra is decreased.

The above ferrite core 6 is suitably used as a common-mode noise filter.

Figure 2:
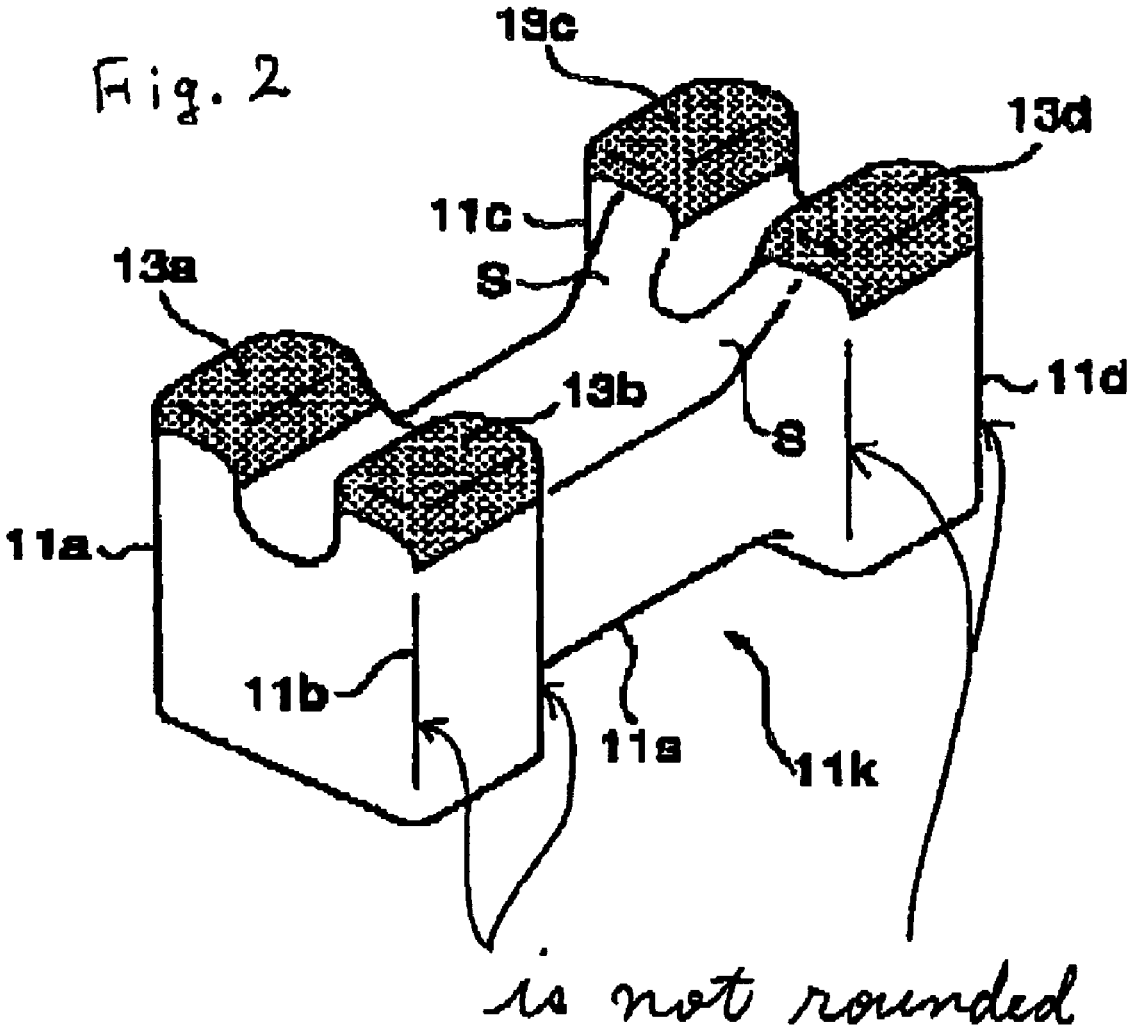
FIG. 2 is a perspective view showing a common-mode noise filter using the ferrite core according to the first embodiment of the present invention.

FIG. 2 is a perspective view showing an embodiment of a common-mode noise filter using the ferrite core 6 of the present invention with the bottom side up.

According to the common-mode noise filter of the first embodiment, a ferrite core 6 includes a wound core 4 and the flanges 1A and 1B provided at both ends, and the flange 1A includes legs 2*a* and 2*b* and the flange 1B includes legs 2*c* and 2*d*. In addition, electrodes 3*a*, 3*b*, 3*c* and 3*d* are formed on the top surfaces of the legs 2*a*, 2*b*, 2*c* and 2*d*, respectively. Two (plural) conductors are wound around the wound core 4 of the ferrite core 6 constituted as described above, by several turns to some dozen turns by bifilar winding or the like, starting ends of the two conducts are connected to the electrodes 3*c* and 3*d* by soldering, thermo-compression or the like so as to be electrically conductive, and finishing ends of the conductors are connected to the electrodes 3*a* and 3*b* by soldering, thermo-compression or the like so as to be electrically conductive.

Thus, when the leg 2 is tapered off and the vertical corner portion has a curved surface, since the plating of the electrode 3 is prevented from elongating, the distances between the adjacent legs 2 and electrodes 3 can be kept at a predetermined value or more, and insulation resistance between the electrodes 3 of the common-mode noise filter can be retained. In addition, since the plating is prevented from elongating, even when the conductor wire pressed toward the adjacent electrodes 3 passes by the electrode 3, short-circuit does not occur. In addition, since the volume of the electrode 3 is decreased because its elongating is prevented and its dimension is stable, the Q value (loss characteristic) can be improved and stabilized.

Second Embodiment

A common-mode noise filter according to second to fourth embodiments as will described below is characterized in that projection lengths of the legs toward a wound core (inward projection lengths) are different from each other at first and second flanges 1 and 2 in a ferrite core in order to increase the distance between the conductor wire and the legs which need to be insulated. The second embodiment shows a concrete example thereof.

Figure 7A:
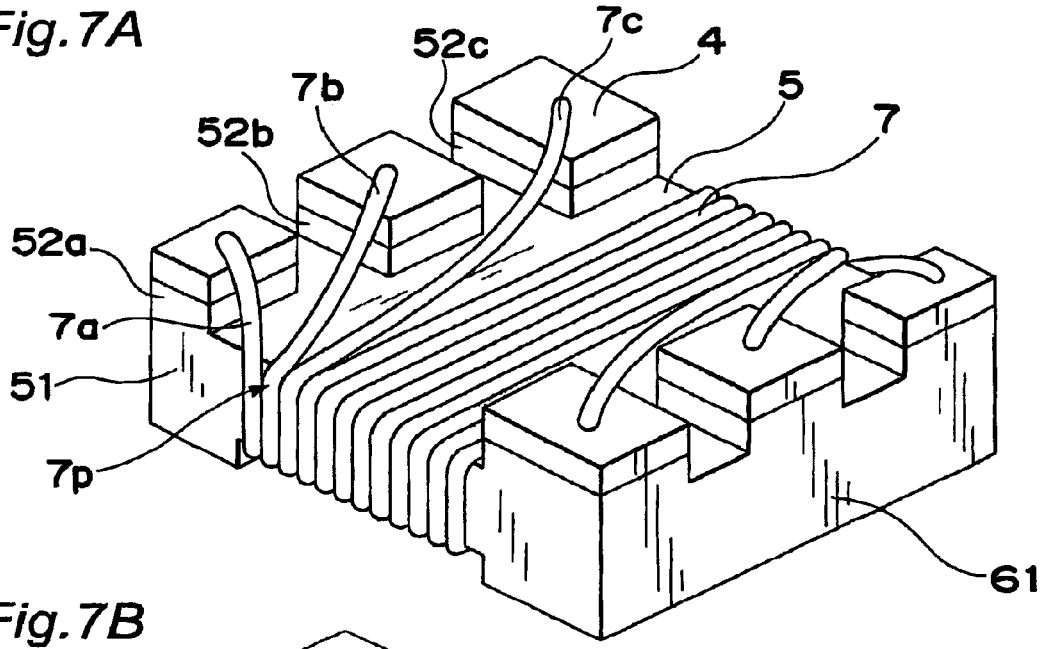
FIG. 7A is a perspective view showing a common-mode noise filter according to a second embodiment of the present invention.
Figure 7B:
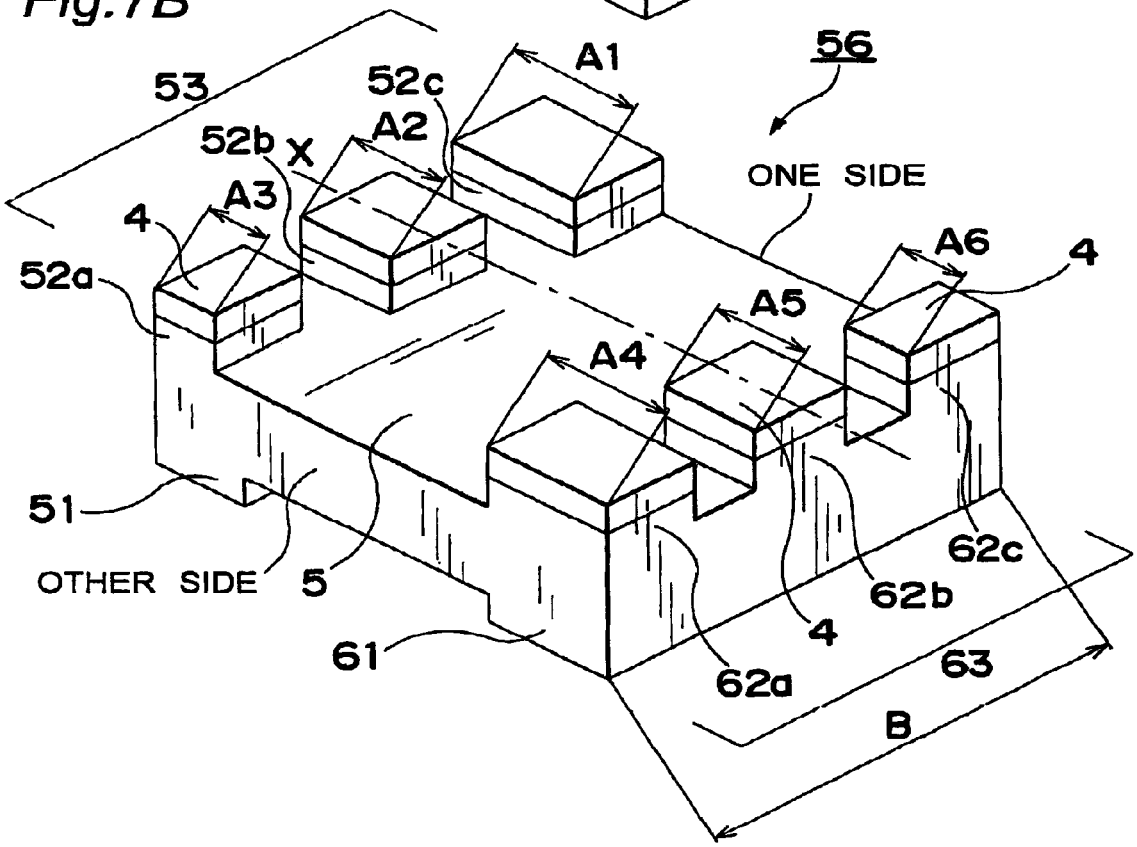
FIG. 7B is a perspective view showing a ferrite core in the common-mode noise filter according to the second embodiment.

FIG. 7A is a perspective view showing a common-mode noise filter in which the conductor wire is wound around the ferrite core according to the second embodiment of the present invention and FIG. 7B is a perspective view showing a ferrite core 56 according to the second embodiment.

The ferrite core 56 includes a ferrite porcelain formed of a magnetic material such as Ni—Zn ferrite, Mn—Zn ferrite or the like, and the wound core 5 and flanges 51 and 61 are integrated. The flanges 51 and 61 are formed at both ends of the wound core 5 such that stepped parts may be formed and one stepped part of the flange 51 (a first flange 53) is divided into a plurality of legs 52*a* to 52*c*, and one stepped part of the flange 61 (a second flange 63) is divided into a plurality of legs 62*a* to 62*c*. In addition, an electrode 4 is formed on each top surface of the legs 52*a* to 52*c*, and 62*a* to 62*c*.

According to the ferrite core 56 of 2520 size, since a short-side dimension B is 2.0 mm, the distance between the legs 52*a* to 52*c* becomes very small such as about 0.4 mm. The reason why the distance is set at about 0.4 mm is that a high-viscous paste used in printing a thick film conductor when the electrode 4 is formed may not be short-circuited while breaking strength of the legs 52*a* to 52*c* is kept at a predetermined value or more.

According to the common-mode noise filter of the second embodiment, the conductor wire 7 is wound around the wound core 5 of the ferrite core 56 constituted as described above and shown in FIG. 7B and its both ends are connected to the electrodes 4 of the legs 52*a* to 52*c* and 62*a* to 62*c*.

Hereinafter, description will be given of the ferrite core 56 according to the second Embodiment of the present invention.

According to the ferrite core 56 of the second embodiment, maximum lengths A3 to A1 of the legs 52*a* to 52*c* of the first flange 53, which are parallel to the direction of an X-axis of the wound core 5, are gradually shortened from the leg 52*c* on one side face to the leg 52*a* on the other side face. That is, A1<A2<A3. In addition, maximum lengths A4 to AG of the legs 62*a* to 62*c* of the second flange 63, which are parallel to the direction of an X-axis of the wound core 5, are gradually shortened from the leg 62*a* on the other side face to the leg 62*c* on one side face. That is, A4>A5>A6.

More specifically, according to the ferrite core of the second embodiment, the projection lengths of the legs 52*a* to 52*c* of the first flange 53 and the legs 62*a* to 62*c* of the second flange 61 toward the wound core are sequentially varied such that A1<A2<A3 and A4>A5>A6 so as to provide enough distances between the conductor wire 7 and the legs, which need to be insulated from each other and so as to equalize the distance between the legs 52*a* and 62*a*, the distance between the legs 52*b* and 62*b*, and the distance between the legs 52*c* and 62*c*.

That is, in the common-mode noise filter which is made using the above ferrite core 56, when the conductor wire 7 wound around the wound core 5 is wired to each of the legs 52*a* to 52*c* and 62*a* to 62*c*, a short-circuit can be prevented and pressure deterioration can be also prevented.

For example, as shown in FIG. 7A, if the conductor wire 7 includes three wires 7*a*, 7*b* and 7*c*, when the wire 7*a* which is closest to the flange 51 is connected to the electrode 4 of the leg 52*a*, the wire 7*b* is connected to the electrode 4 of the leg 52*b*, and the wire 7*c* is connected to the electrode 4 of the leg 52*c*, the distance between the electrode 4 of the leg 52*a* and the wire 7*b* and the distance between the electrode 4 of the leg 52*b* and the wire 7*c* can be kept at a predetermined value or more. As a result, a short-circuit and pressure deterioration can be prevented. The same is true of the side of the flange 61.

Although the description was made of the case where the number of legs of each of the first flange 63 and the second flange 63 is three with reference to FIGS. 7A and 7B, the number may be two in the present invention.

That is, as shown in FIG. 8, a length A3 of a leg 52*a* in the X-axis direction is shorter than a length A1 of a leg 52*c* in the X-axis direction in a first flange 53, that is, A3<A1. In addition, a length A4 of a leg 62*a* in the X-axis direction is longer than a length A6 of a leg 62*c* in the X-axis direction in a second flange 63, that is, A4>A6.

Figure 8A:
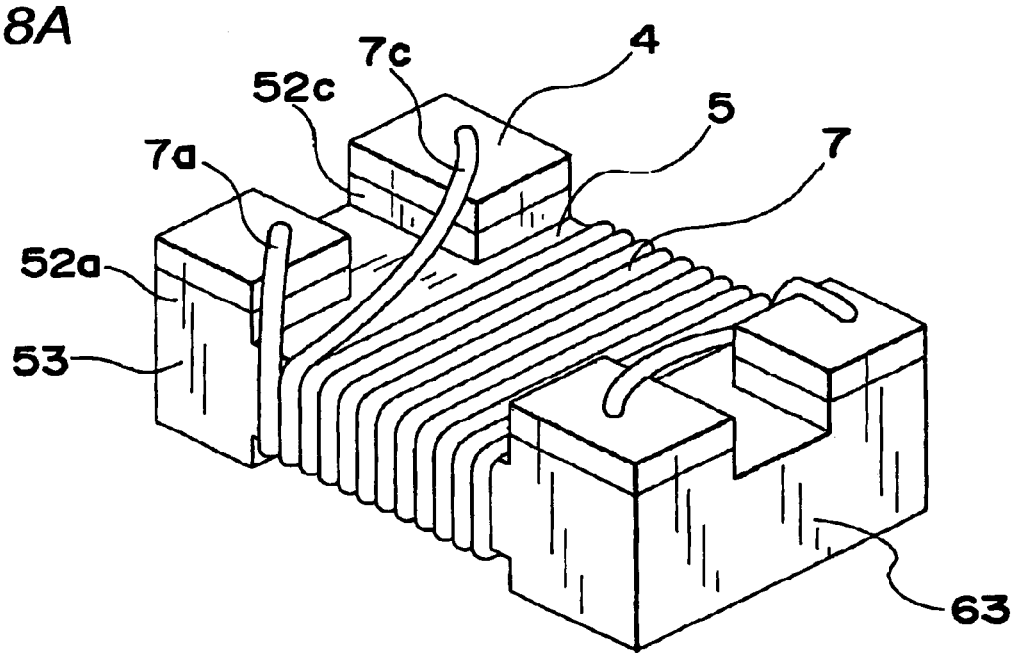
FIG. 8A is a perspective view showing a common-mode noise filter according to a third embodiment or the present invention.
Figure 8B:
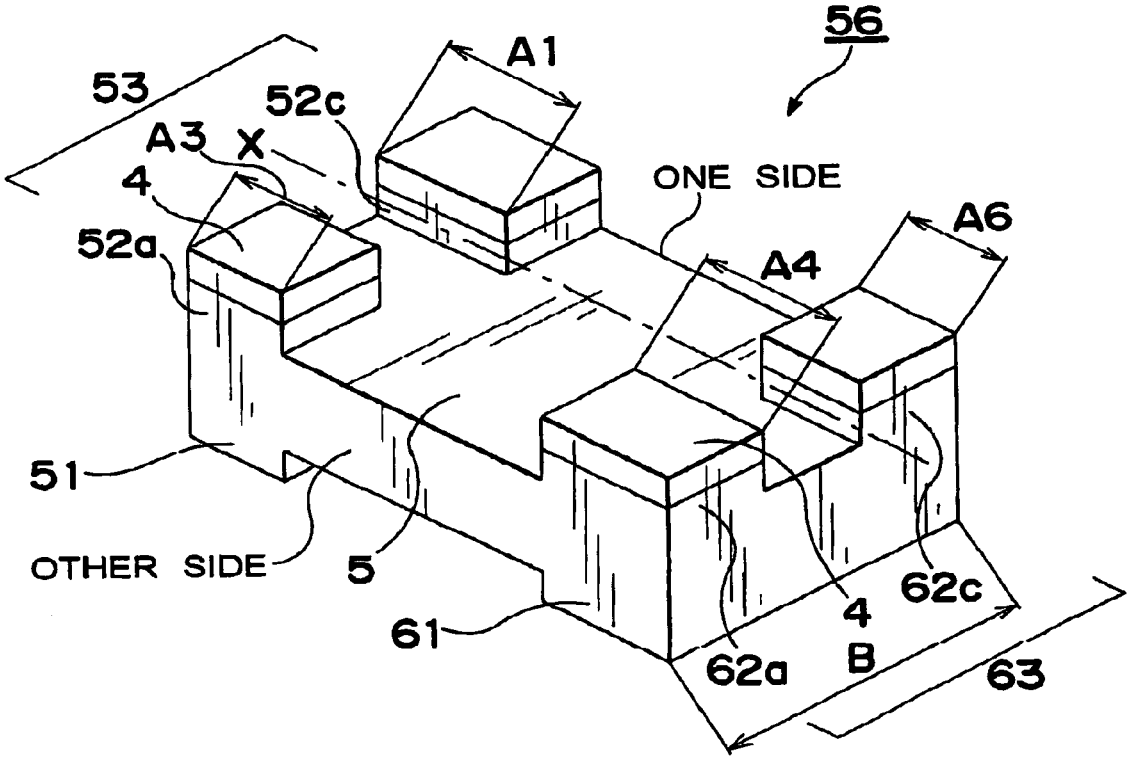
FIG. 8B is a perspective view showing a ferrite core in the common-mode noise filter according to the third embodiment.

When a common-mode noise filter is made using a ferrite core 56 shown in FIG. 8B, similar to the common-mode filter shown in FIG. 7A, a short-circuit and pressure deterioration can be prevented in wiring the conductor wire 7 wound around a wound core to each of the legs 52*a*, 52*c*, 62*a* and 62*c*.

For example, as shown in FIG. 8A, if the conductor wire 7 includes two wires 7*a* and 7*c*, when the wire 7*a* which is the closest to a flange 51 is connected to an electrode 4 of the leg 52*a*, and the wire 7*c* is connected to the electrode 4 of the leg 52*c*, a distance between the electrode 4 of the leg 52*a* and the wire 7*c* can be kept at a constant value or more. As a result, a short-circuit and pressure deterioration can be prevented. The same is true of the side of a flange 61.

In addition, according to the second embodiment, since the lengths A3 to A1 of the legs 52*a* to 52*c* in the X-axis direction are specified, when the wires 7*a*, 7*b* and 7*c* are separated to be wired to the legs 52*a* to 52*c*, an angle θab formed between the wires 7*a* and 7*b* and an angle θbc formed between the wires 7*b* and 7*c* can be largely provided.

Furthermore, according to the lengths A1 to AG of the legs 52*a* to 52*c* and 62*a* to 62*c*, when it is assumed that A1 and A4 are set at 1, A2 and A5 are preferably set at ¾ thereof or less, and when it is assumed that A2 and A5 are set at 1, the A3 and A6 are preferably set at ¾ thereof or less. Thus, when the wire 7*a* is connected to the electrode 4 of the leg 52*a*, the wire 7*b* is connected to the electrode 4 of the leg 52*b*, and the wire 7*c* is connected to the electrode 4 of the leg 52*c*, the distance between the electrode 4 of the leg 52*a* and the wire 7*b* and the distance between the electrode 4 of the leg 52*b* and the wire 7*c* can be sufficiently provided. Consequently, a short-circuit and pressure deterioration can be effectively prevented. In addition, it is needless to say that the same is true of the side of the flange 61.

In addition, according to the ferrite core 56 of the second embodiment, a transverse sectional (section parallel to the top surface) shape of each of the legs 52*a*, 52*c*, 62*a* and 62*c* is the same regardless of its position, so that the transverse section of each leg at the root has the same shape as that of the top surface. According to the second embodiment, since the area of the top surface is provided without being decreased depending on the height of the leg, a bonding area at the time of mounting is not decreased and adhesion strength can be stably provided.

Third Embodiment

Next, description will be made to a ferrite core according to a third embodiment of the present invention with reference to FIGS. 9 to 11.

The ferrite core of the third embodiment of the present invention includes a plurality of legs each having sectional shape in which long and short axes are provided and an aspect ratio is 1 or more, at each flange. The plurality of legs are arranged such that their long-axis directions are not parallel to each other, at each flange.

Figure 9A:
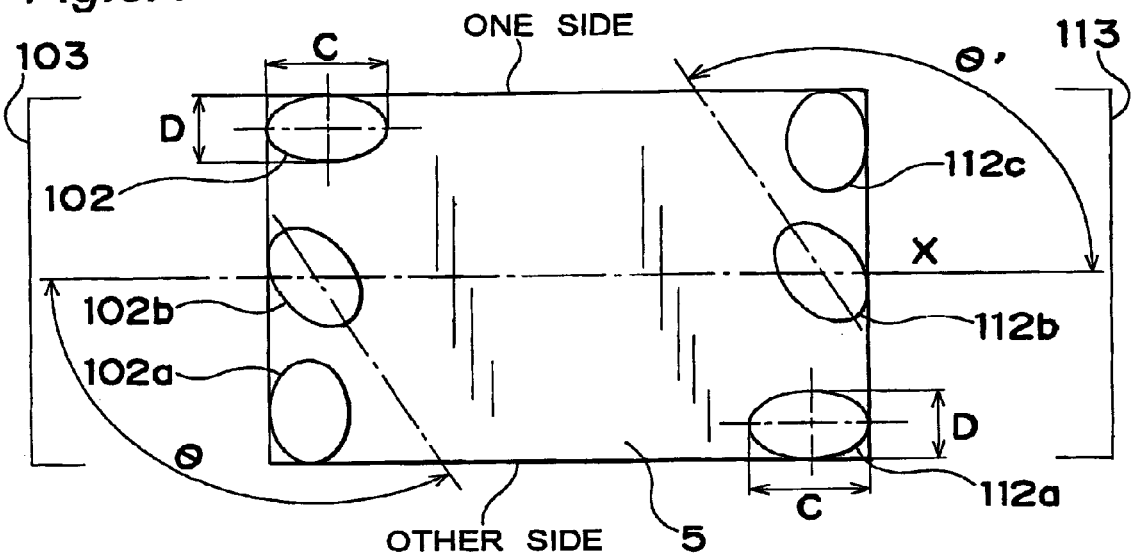
FIGS. 9A and 9B are plan views showing a ferrite core according to a first modification of the third embodiment.
Figure 9B:
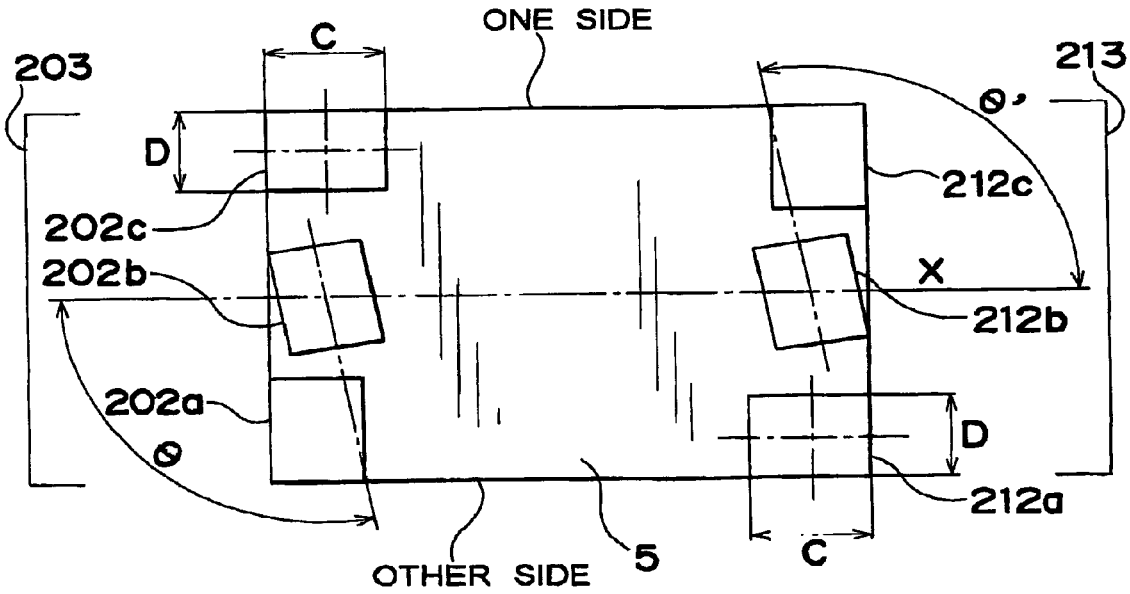

FIG. 9A shows an example in which a plurality of legs have oval sectional shapes and FIG. 9B shows an example in which a plurality of legs have rectangular sectional shapes. Referring to FIGS. 9A and 9B, reference character C designates a length of the long axis of the leg and reference character D designates a length of the short axis of the leg. In addition, the aspect ratio (C/ID) is larger than 1, and each of lengths C and D of the long and short axes, is the same at the top surface, at the root of the leg and the middle thereof.

Referring to the example shown in FIG. 9A, angles θ formed between the long axes of legs 102*a* to 102*c* provided at a first flange 103 and the X-axis direction of a wound flange 5 are set so as to be gradually increased toward one side face, and angles θ' formed between the long axes of legs 112*a* to 112*c* provided at a second flange 113 and the X-axis direction of the wound flange 5 are set so as to be gradually decreased toward one side face.

According to the example shown in FIG. 9A, preferably, the leg 102*c* arranged on the one side face is formed such that the angle θ formed between its long axis and the X-axis direction of the wound core 5 may be 180 degrees, the leg 102*a* arranged close to the other side face is formed such that the angle θ formed between its long axis and the X-axis direction of the wound core 5 may be 90 degrees, and the leg 102*b* is formed such that the angle θ formed between its long axis and the X-axis direction of the wound core 5 may be larger than 90 degrees but smaller than 180 degrees, in the flange 103.

According to the example shown in FIG. 9A, the leg 112*c* arranged on the one side face is formed such that the angle θ formed between its long axis and the X-axis direction of the wound core 5 may be 90 degrees, the leg 112*a* arranged close to the other side face is formed such that the angle θ formed between its long axis and the X-axis direction of the wound core 5 may be 180 degrees, and the leg 112*b* is formed such that the angle θ formed between its long axis and the X-axis direction of the wound core 5 may be larger than 90 degrees but smaller than 180 degrees, in the flange 113.

Referring to the example shown in FIG. 9B also, angles θ formed between the long axes of legs 202*a* to 202*c* provided at a first flange 203 and the X-axis direction of the wound core 5 are set so as to be gradually increased toward one side face, and angles θ' formed between the long axes of legs 212*a* to 212*c* provided at a second flange 213 and the X-axis direction of the wound core 5 are set so as to be gradually decreased toward the one side face.

According to the example shown in FIG. 9B, preferably, the leg 202*c* arranged on the one side face is formed such that the angle θ' formed between its long axis and the X axis direction of the wound core 5 may be 180 degrees, the leg 202*a* arranged close to the other side face is formed such that the angle θ' formed between its long axis and the X-axis direction of the wound core 5 may be 90 degrees, and the leg 202*b* is formed such that the angle θ' formed between its long axis and the X-axis direction of the wound core 5 may be larger than 90 degrees but smaller than 180 degrees, in the flange 203.

According to the example shown in FIG. 9B, the leg 212*c* arranged on the one side face is formed such that the angle θ' formed between its long axis and the X-axis direction of the wound core 5 may be 90 degrees, the leg 212*a* arranged close to the other side face is formed such that the angle θ' formed between its long axis and the X-axis direction of the wound core 6 may be 180 degrees, and the leg 212*b* is formed such that the angle θ' formed between its long axis and the X-axis direction of the wound core 5 may be larger than 90 degrees but smaller than 180 degrees, in the flange 213.

Thus, since the plurality of legs having the sectional shapes in which the aspect ratio is 1 or more are arranged such that their directions are gradually varied, the projection amount of the leg toward the wound core can be adjusted and the distance between the conductor wire 7 and the leg can be freely designed. As a result, a short-circuit can be prevented and pressure deterioration can be prevented at the time of wiring.

In addition, according to the ferrite core of the third embodiment, since the bottom areas of the legs 102*a* to 102*c* and 112*a* to 112*c* (or legs 202*a* to 202*c* and 212*a* to 212*c*) can be almost the same size, the bonding strength at the time of mounting can be stably provided.

Besides, according to this specification, the long axis means the longest axis passing through the center of gravity of the top surface of each of the legs 102*a* to 102*c* and 112*a* to 112*c*, and the short axis means the shortest axis passing through the center of gravity and crossing the long axis at right angles.

Furthermore, the fact that the bottom areas of the legs 102*a* to 102*c* and 112*a* to 112*c* are substantially the same shows that variation of the bottom areas of the legs is in a range of ±10.

Still furthermore, the angle θ formed between each of the legs 102*a* to 102*c* and 112*a* and 112*c* and the X-axis is preferably set in a range so that a short-circuit caused by contacts between electrodes 4 after the electrodes 4 are formed at the adjacent legs may not be generated.

Regarding miniaturization, the distance between the conductor wire 7 and each of the legs 102*a* to 102*c* and 112*a* to 112*c* is preferably designed so as to be decreased to the minimum.

Although the above description was made with reference to signs allotted in FIG. 9A, the same is true of FIG. 9B.

In addition, according to the ferrite core in FIG. 9A, since the sectional shape is in the shape of an oval and there is no corner on the side face, even if the conductor wire 7 comes in contact with the legs 102*a* to 102*c* and 112*a* to 112*c*, there is a further advantage such that pressure deterioration does not occur easily.

Still further, the third embodiment may be modified as follows.

MODIFICATIONS

Figure 10:
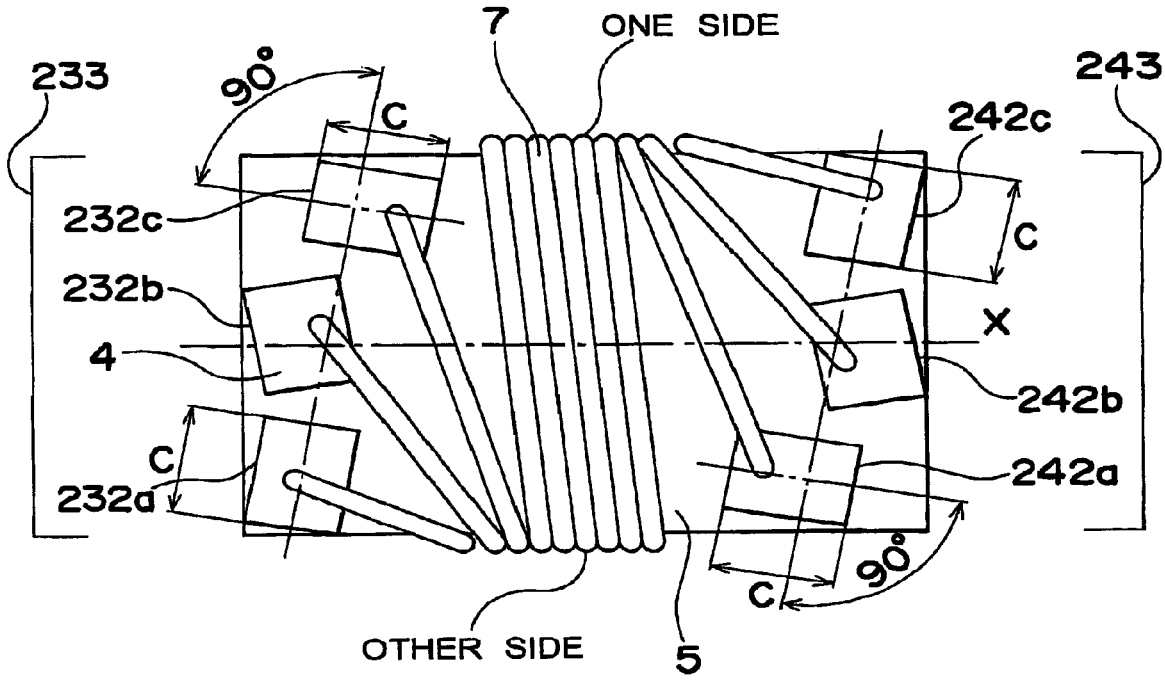
FIG. 10 is a plan view showing a common-mode noise filter according to the first modification of the third embodiment.

According to n ferrite core shown in FIG. 10, legs are inclined in first and second flanges 233 and 243 and at least one leg in each flange is formed so as to be separated from an end face. Referring to a ferrite core shown in FIG. 10, a leg 232*c* and a leg 242*a* in which a wiring length of a conductor wire 7 becomes longest are formed so as to be separated from the end face. Thus, a degree of freedom in designing arrangement of the legs is increased, a distance between the conductor wire 7 and the leg can be set in an appropriate range and a short-circuit and pressure deterioration at the time of wiring can be effectively prevented.

According to the ferrite core shown in FIG. 10, an angle formed between each of long axes of the legs 232*c* and 242*c* formed on one side face and each of long axes of the legs 232*a* and 242*a* formed on the other side face among the legs 232*a* to 232*c* and 242*a* to 242*c* in the first and second flanges 233 and 243, respectively is set at about 90 degrees. Furthermore, the following is further preferable.

That is, the leg 232*a* formed on the other side face in the first flange 233 is arranged so as to be inclined from the direction in which its long axis crosses the X-axis at right angles, and the leg 232*c* formed on the one side face is rotated and moved to the inside corresponding to the inclination (FIG. 10).

Thus, since the distance between the conductor wire 7 connected to the leg 232*c* and the legs 232*b* and 232*a* can be largely provided, a short-circuit and pressure deterioration caused by contacts between electrodes 4 on the legs 232*b* and 232*a* can be prevented. As a result, safety is increased furthermore.

Similarly, the leg 242*c* formed on one side face in the second flange 243 is arranged so as to be inclined from the direction ill which its long axis crosses the X-axis at right angles, and the leg 242*a* formed on the other side face is rotated and moved to the inside corresponding to the inclination (FIG. 10).

Thus, since the distance between the conductor wire 7 connected to the leg 242*a*, and the legs 242*b* and 242*c* can be largely provided, a short-circuit and pressure deterioration caused by contacts between electrodes 4 on the legs 242*b* and 242*c* can be prevented. As a result, safety is increased furthermore.

Figure 11A:
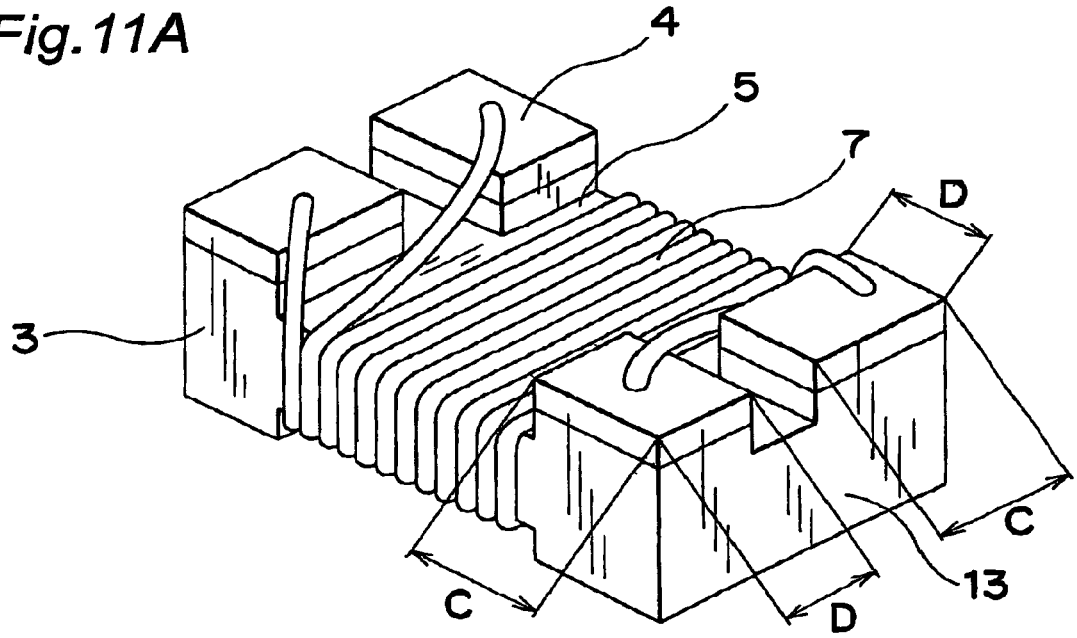
FIG. 11A is a perspective view showing a common-mode noise filter according to a second modification of the third embodiment.
Figure 11B:
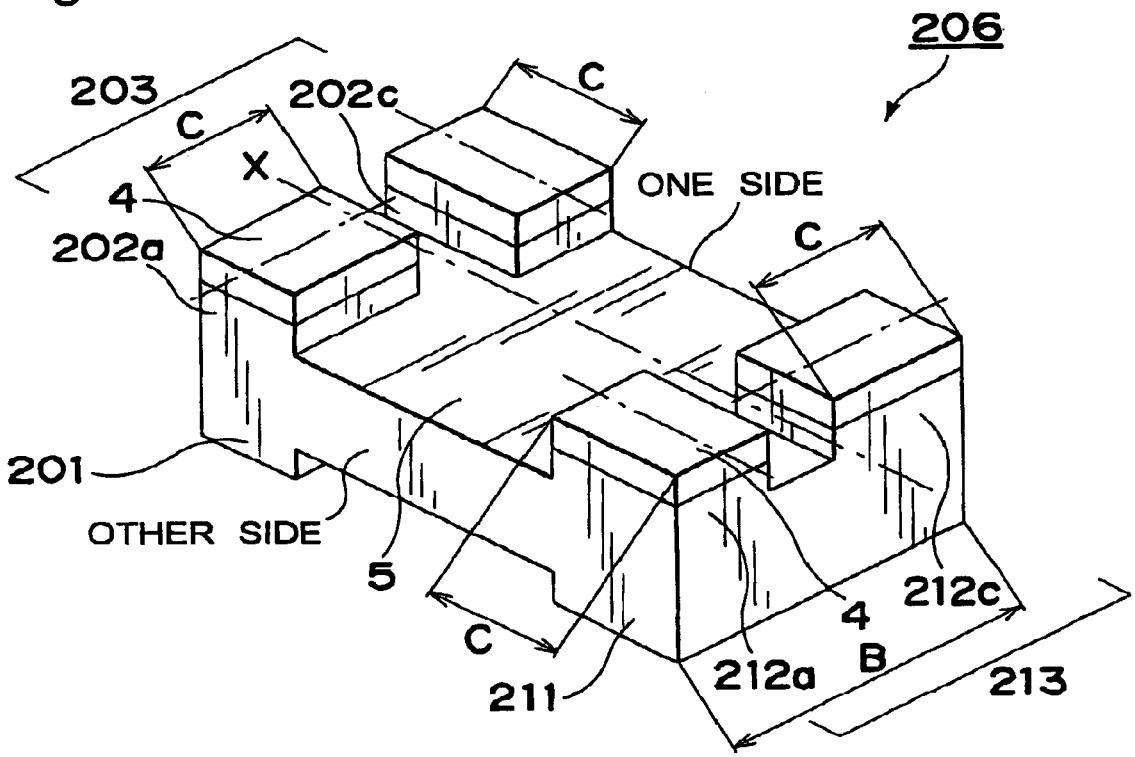
FIG. 11B is a perspective view showing a ferrite core of the common-mode noise filter according to the second modification of the third embodiment.

FIG. 11B shows a ferrite core 206 in which each of first and second flanges are constituted by two legs and FIG. 11A shows a common-mode noise filter constituted using the ferrite core 206.

According to the ferrite core 206 shown in FIG. 11B, the legs 202*b* and the leg 212*b* are omitted from the ferrite core shown in FIG. 9B. Thus, the distance between legs 202*a* and 202*c* and the distance between legs 212*a* and 212*c* are narrowed because the legs 202*b* and 212*b* are omitted.

According to the ferrite core 206 shown in FIG. 11B, as a preferable example, among the legs 202*a* and 202*c* of a first flange 203 and the legs 212*a* and 212*c* of a second flange 213, the long axes of the legs 202*a* and 212*c* formed on the one side face are perpendicular to the X-axis of the wound core 5, and the long axes C of the legs 202*c* and 212*a* formed on the other side face are parallel to the X-axis of the wound core 5.

According to the ferrite core 206 shown in FIG. 11B, in addition to the same effect as in the ferrite core shown in FIG. 9B, when the conductor wire 7 is wound around as shown in FIG. 11A, the distance between the conductor wire 7 and each of the legs 202*a*, 202*c*, 212*a* and 212*c* can be largely provided by increasing a dimension ratio between the long axis length C and the short axis length D in the bottom shapes of the legs 202*a*, 202*c*, 212*a* and 212*c*. As a result, safety is increased furthermore.

Fourth Embodiment

Next, description will be given of a ferrite core according to a fourth embodiment of the present invention with reference to FIGS. 12 and 13.

According to a ferrite core 306 according to the fourth embodiment of the present invention, legs 302*a*, 302*c*, 312*a*, 312*c* of first flange 303 and second flange 313 are provided so as to project from the side faces of a wound core 5.

Figure 12A:
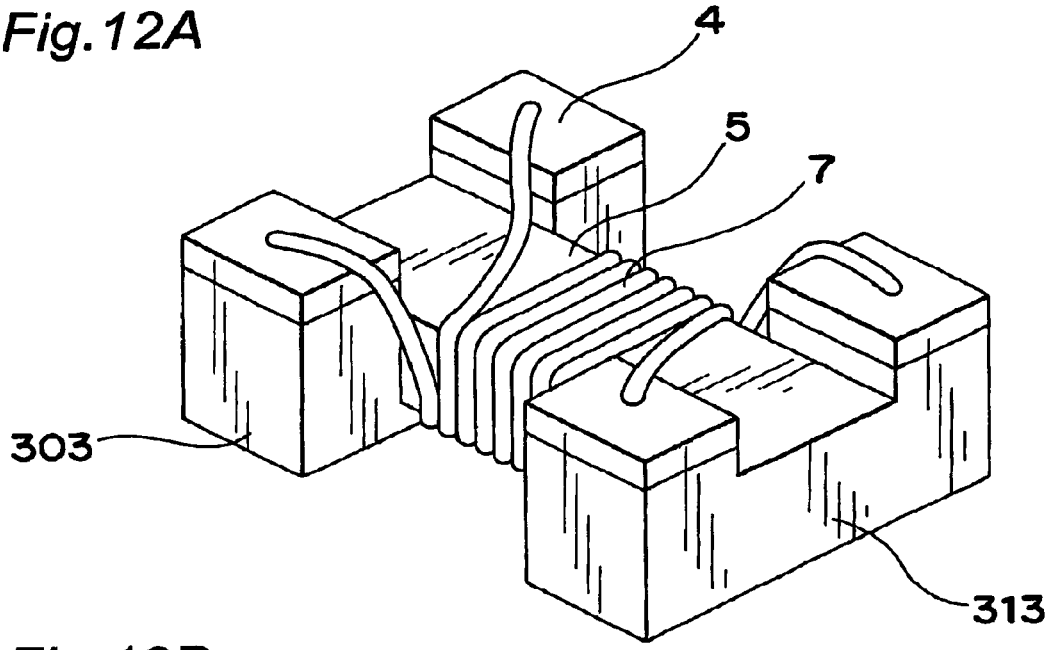
FIG. 12A is a perspective view showing a common-mode noise filter according to a fourth embodiment of the present invention.
Figure 12B:
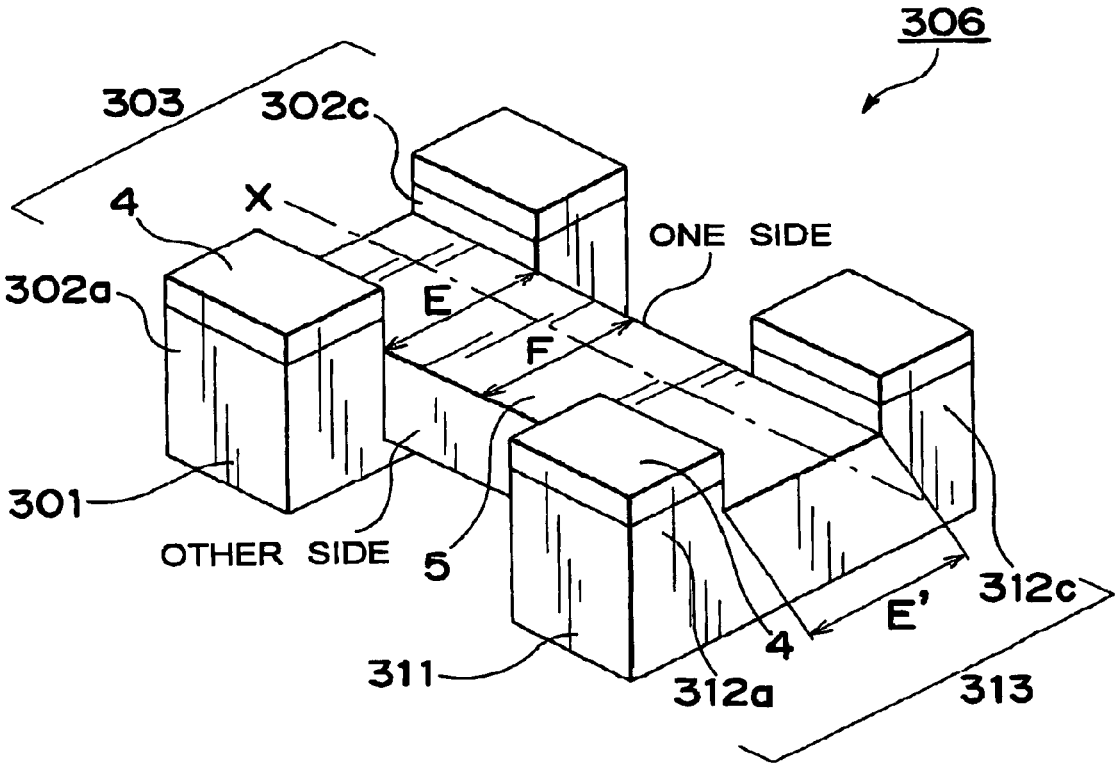
FIG. 12B is a perspective view showing a ferrite core in the common-mode noise filter according to the fourth embodiment.

According to a ferrite core shown in FIG. 12B, a distance E between legs 302*a* and 302*c* in a first flange 303 is the same as a width F of a wound core 5 and a distance E' between legs 312*a* and 312*c* in a second flange 313 is the same as the width F of the wound core 5.

Figure 13A:
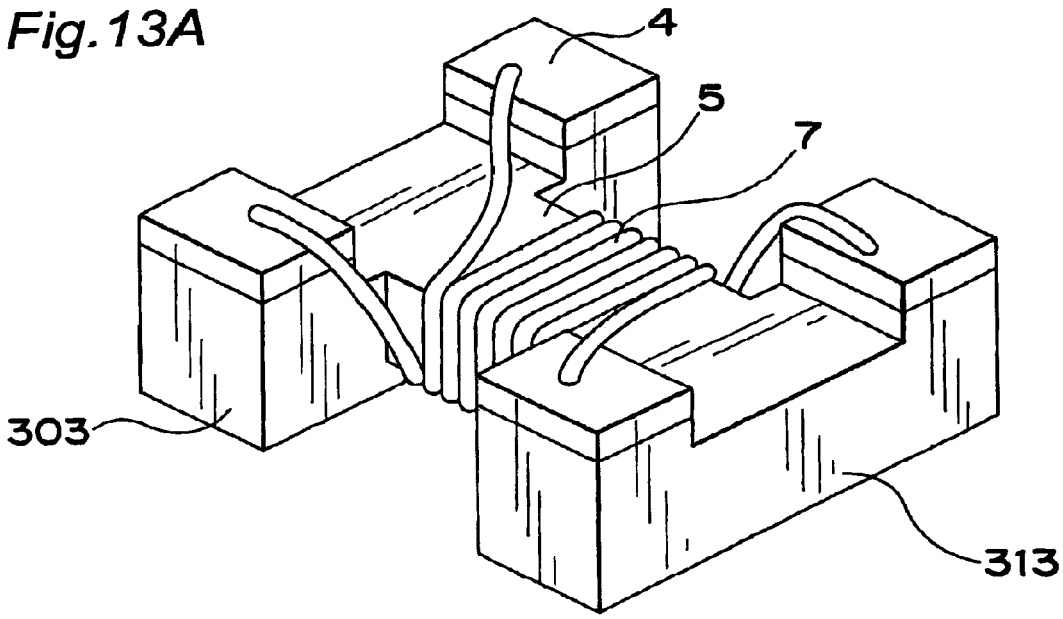
FIG. 13A is a perspective view showing a common-mode noise filter according to a first modification of the fourth embodiment.
Figure 13B:
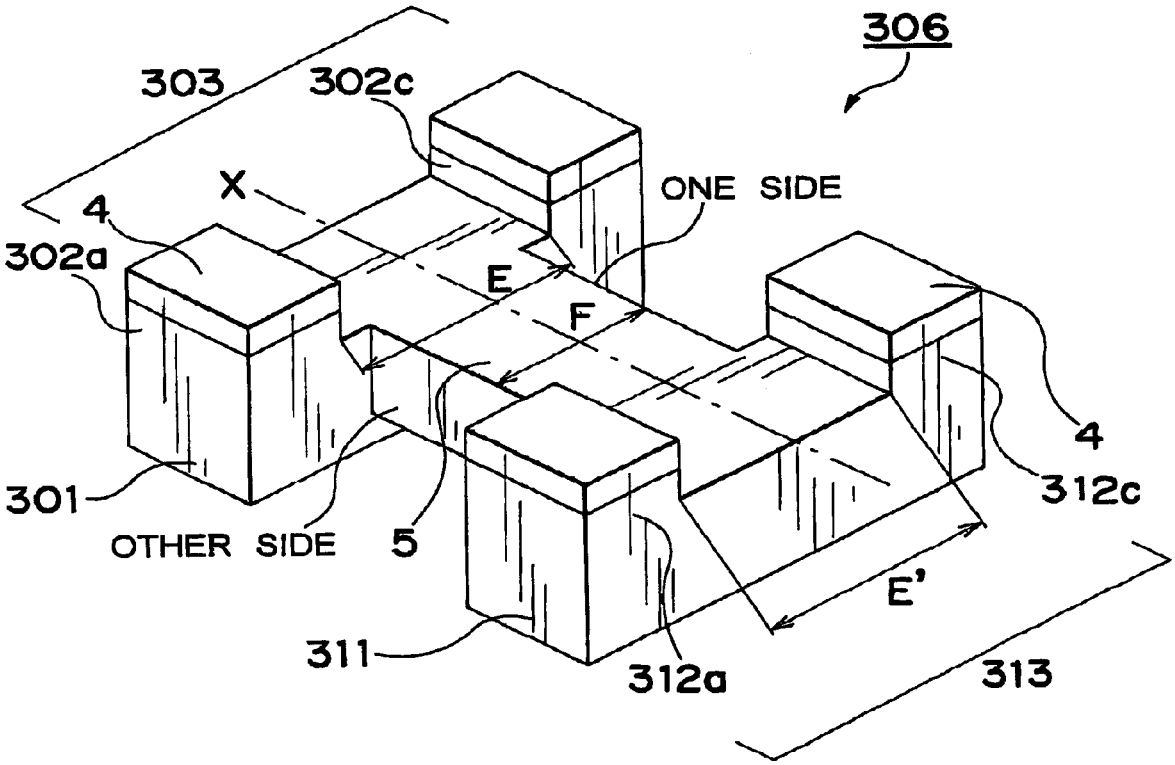
FIG. 13B is a perspective view showing a ferrite core of the common-mode noise filter according to the first modification of the fourth embodiment.

In addition, according to a ferrite core shown in FIG. 13B, a distance E between legs 302*a* and 302*c* in a first flange 303 is longer than a width F of a wound core 5 and a distance E' between legs 312*a* and 312*c* in a second flange 313 is longer than the width F of the wound core 5.

According to the ferrite core 306 shown in FIGS. 12B and 13B of the fourth embodiment, when a common-mode noise filter in which a conductor wire 7 is wound is made, the leg 302*a* does not become an obstacle when the conductor wire 7 is connected to the leg 302*c* and a short-circuit caused by contacts between the conductor wire 7 connected to the leg 302*c* and the electrode 4 of the leg 302*a* can be prevented, and pressure deterioration is also prevented. The same is true of the second flange 313.

In addition, as shown in FIG. 12, when the distance E between boundaries with the wound core 5 is the same as the width F of the wound core 5, a constitution of a die can be extremely simplified, so that the manufacturing cost for the die can be lowered.

In addition, as shown in FIG. 13, when the distance E between boundaries with the wound core 5 is longer than the width F of the wound core 5, the distance between the conductor wire 7 connected to the electrode 4 of the leg 302*c*, and the leg 302*a*, and the distance between the conductor wire 7 connected to the electrode 4 of the leg 312*a*, and the leg 312*c* can be more largely provided than the case where the distance E between the boundaries with the wound core 5 is the same as the width F of the wounded core 5. As a result, a short-circuit and pressure deterioration can be more effectively prevented.

In addition, according to the ferrite core 306 shown in FIG. 13B, to effectively prevent a short-circuit and pressure deterioration, the distances E and E' are preferably provided so as to be larger than the width F of the wound core 5 by a wire diameter of the conductor wire or more.

Here, the distance E between the legs 302*a* and 302*c* is the distance between the boundaries with the wound core 5 in the direction perpendicular to the X-axis of the wound core, and the distance E' between the legs 312*a* and 312*c* formed in the second flange 313 is the distance between the boundaries with the wound bore 5 in the direction perpendicular to the X-axis of the wound core 5. Therefore, even when the legs 302*a*, 302*c*, 312*a* and 132*c* are tapered off toward the top surfaces and the like, the distance is defined as a distance between the legs at the boundary with the wound core 5.

Although the width F of the wound core 5 is the central width of the wound core 5, when the distances E and E' between the legs are the same as the width F of the wound core as shown in FIG. 12B, the same place of the distances E and E' between legs corresponds to the width F of the wound core 5.

Thus, since the widths E between the legs 302*a*, 302*c*, 312*a* and 312*c* are defined at the boundaries with the wound core 5, even when the sectional area of each of the legs 302*a*, 302*c*, 312*a* and 312*c* is tapered off, the legs do not become obstacles of the conductor wire 7 wound around the wound core 5.

Although the description was made of the case each of the first and second flanges 303 and 313 is provided with two legs with reference to FIGS. 12 and 13, each of the first and second flanges 303 and 313 may be provided with three legs or more. In this case, the distance E is defined as the distance between legs arranged at the outermost part.

Figure 14A:
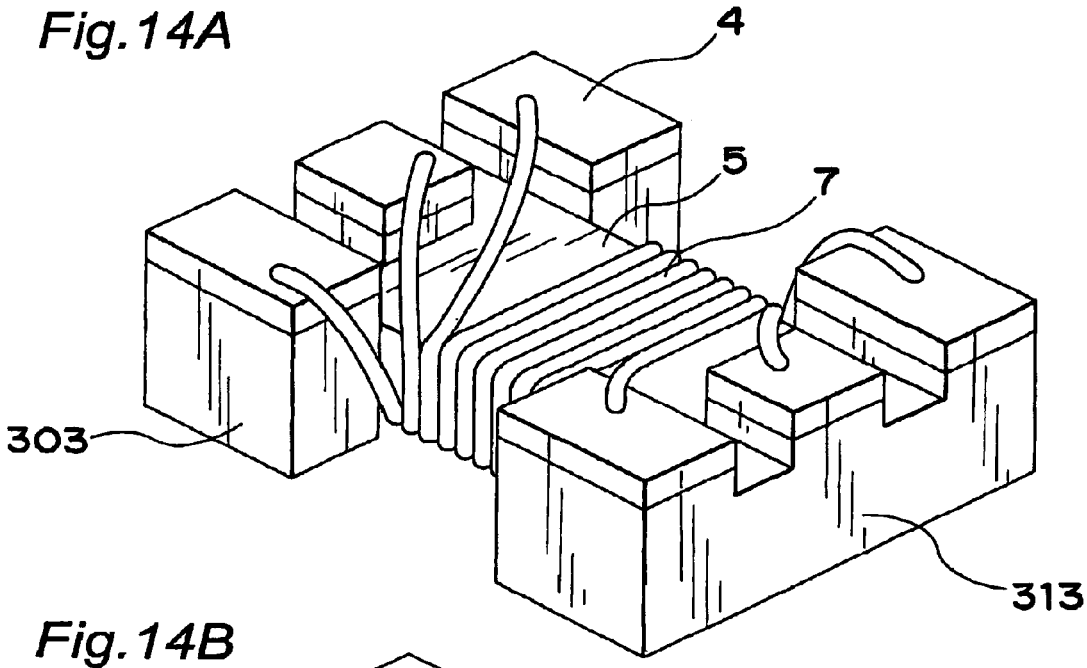
FIG. 14A is a perspective view showing a common-mode noise filter according to a second modification of the fourth embodiment.
Figure 14B:
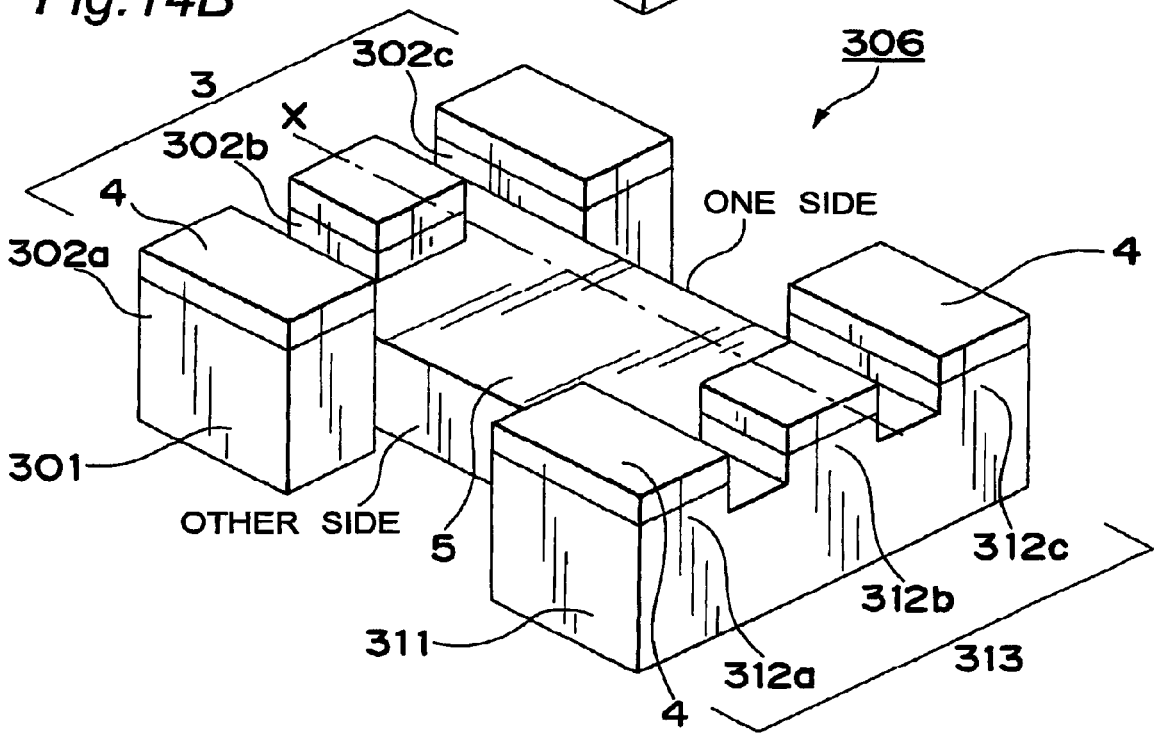
FIG. 14B is a perspective view showing a ferrite core of the common-mode noise filter according to the second modification of the fourth embodiment.
Figure 15A:
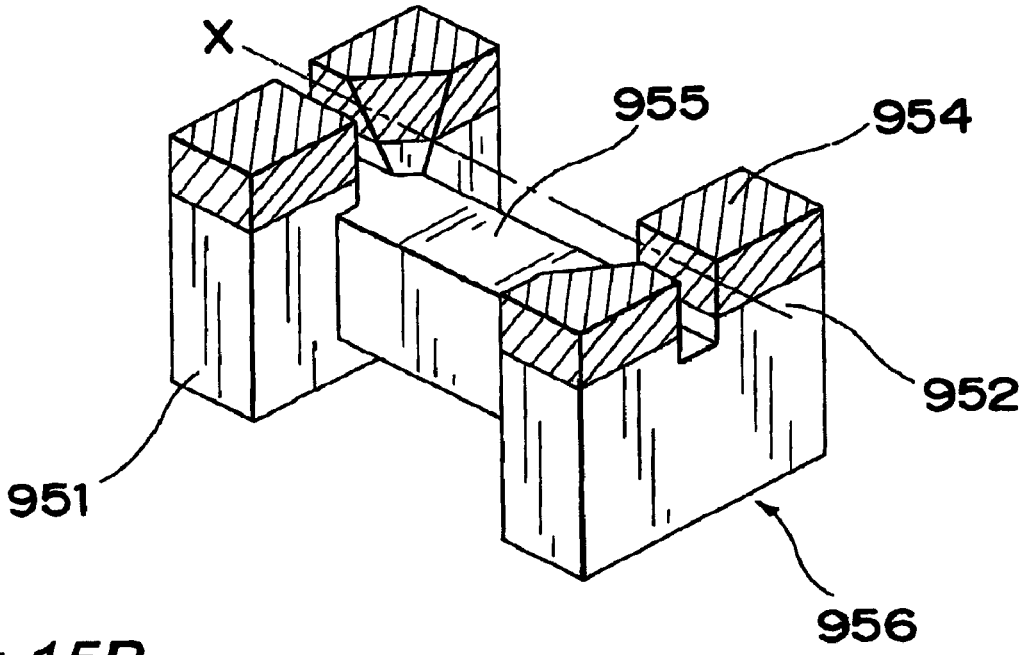
FIG. 15 is a view showing a ferrite core according to a second conventional example.
Figure 15B:
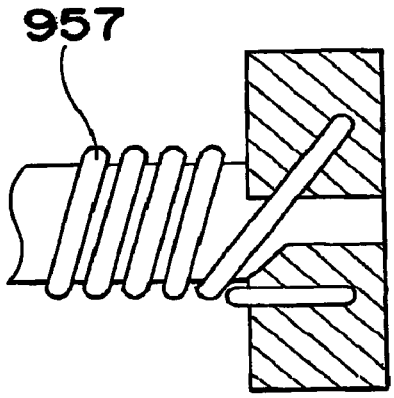
Figure 15C:
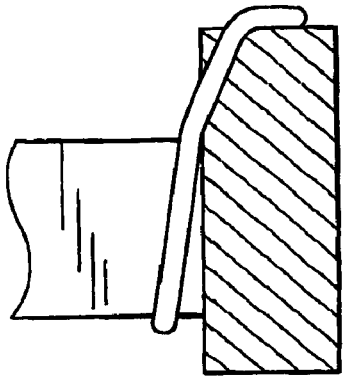

According to a ferrite core 306 of the fourth embodiment in which each of first and second flanges 303 and 313 is provided with three logs, as shown in FIG. 14B, legs 302*b* and 312*b* in the middle among legs 302*a* to 302*c* and 312*a* to 312*c* are preferably smaller than the legs 302*a*, 302*c*, 312*a* and 312*c* on both sides.

Thus, when a common-mode noise filter (FIG. 14A) is made by winding a conductor wire 7 around the ferrite core 306 shown in FIG. 14B, the distance between the conductor wire 7 connected to the leg 312*a*, and the leg 302*b* can be largely provided, and the distance between the conductor wire 7 connected to the leg 312*a*, and the leg 312*b* can be largely provided. As a result, a contact between the conductor wire 7 and the electrode of the leg width should be insulated from the conductor wire 7 is prevented and pressure deterioration can be prevented.

In addition, according to the ferrite core 306 shown in FIG. 14B, since the legs 302*a*, 302*c*, 312*a* and 312*c* on both side are larger, bonding area at the time of mounting is large and adhesion strength can be stably provided.

According to the ferrite core 306 shown in FIG. 14, when it is assumed that a length of each of the legs 302*a*, 302*c*, 312*a* and 312*c* in the X-axis direction is set at 1, a length of each of the legs 302*b* and 312*b* in the X-axis direction is preferably set at ¾ thereof or less. Thus, the contact between the conductor wire 7 and each of the legs 302*a*, 302*c*, 312*a* and 312*c* can be surely prevented and pressure deterioration can be prevented.

In addition, according to the first to fourth embodiments, although a division type is used for the die at the time of molding of the ferrite core, since the section of the leg is constant from the side of the wound core 5 to the side of the top surface, the height of the leg can be freely changed using the same die, so that the height of the leg can be easily adjusted depending on a change of wire diameter of the conductor wire 7.

Thus, even when a request for further lower height is made, the request can be responded without remaking or modifying the die. As a result, the cost for the die can be decreased.

Next, description will be given of a manufacturing method of the ferrite core 56 according to the present invention.

When the ferrite core 56 shown in FIG. 7 is made, raw powder is provided by adding a predetermined binder to powder such as Ni—Zn ferrite or Mn—Zn ferrite which is a raw material of the ferrite porcelain and forming granule suitable for powder molding by a spray drying or the like.

Especially, Ni—Zn ferrite is preferably used in view of a frequency used and a surface resistance value.

Then, the raw powder is put in a die set in a power press-molding machine and pressed by a predetermined pressure to provide a molded body for the ferrite porcelain. This die is divided into the wound core 5 and the legs 52*a* to 52*c* and 62*a* to 62.

Then, the molded body is burned at a predetermined temperature in a furnace such as an electric furnace or a gas furnace and sintered to provide a sintered body which is an original form of the ferrite porcelain.

Then, barreling process is performed for processing the surface of the sintered body and for removing molding flash. According to the barreling process, the sintered body, water, a polishing agent and the like are put in a barrel-shaped container made of porcelain, for example and rotated. In addition, according to the barreling process, batch processing is possible, so that the processing cost can be low. In addition, even when the process is performed with the polishing agent or even when the process is performed by only frictional force with only water, since the polishing process is performed in water in either case, the surface of the sintered body does not unnecessarily get rough and it can keep a necessary strength after the barreling process.

In addition, surface roughness of the sintered body of the ferrite porcelain in which the electrodes 4 of the legs 52*a* to 52*c* and 62*a* to 62*c* are formed is preferably Ra0.2 to 0.6 μm. When the surface roughness is smaller than Ra0.2 μm, the thick film conductors printed at the legs 52*a* to 52*c* and 62*a* to 62*c* are easily peeled off and adhesion strength when mounted as the product is lowered. Meanwhile, when the surface roughness is larger than 0.6 μm, the surface becomes rough and the strength is lowered.

Here, the surface roughness is measured such that the ferrite porcelain is fixed on a flat plate with the legs 52*a* to 52*c* and 62*a* to 62*c* side up and the top surfaces of the legs 52*a* to 52*c* and 62*a* to 62*c* on which the thick film conductors are printed are touched by a sensing pin of a measuring device. The surface roughness Ra is adjusted by a revolution speed of the pot made of porcelain and the like during the barreling process. When the revolution speed of the pot is high, since the sintered bodies impinge on each other or the sintered body impinges on the polishing agent strongly, Ra is increased. When the revolution speed is lowered, the sintered bodies impinge on each other or the sintered body impinges on the polishing agent weakly, Ra is decreased.

Then, electrodes 4 are formed on the top surfaces of the legs 52*a* to 52*c* and 62*a* to 62*c*, by a method such as dipping, screen printing or transferring, such that an electrode paste containing powder such as Ag or AgPd is applied and burned to form the thick film conductor, and Ni or Cu, Sn, SnPb, Au and the like are plated on the thick film conductor to be a multilayer depending on usage or demands. The plated layer is selectively formed on the thick film conductor by soaking the ferrite porcelain on which the thick film conductor is printed, into plating liquid containing Ni, or Cu, Sn, SnPb, Au and the like and applying a current to it. After the plating process, the plating liquid attached on the ferrite porcelain is rinsed well, whereby a desired ferrite core 56 can be provided.

The ferrite core 56 provided as described above is appropriately used for a common-mode noise filter.

A plurality of conductor wires are wound around the wound core 5 of the ferrite core 56 constituted as described, by several turns to some dozen turns by bifilar winding or the like, starting ends and the finishing ends of the conductor wires are connected to the electrodes 4 on the top surfaces of the legs by soldering, thermo-compression or the like.

Thus, the distances between the adjacent legs and between the adjacent electrodes 4 can be maintained by varying the size, the direction and the shape of each leg, so that insulating properties between electrodes 4 of the common-mode noise filter which is a final product can be retained. In addition, even when the conductor wires pressed on the adjacent electrodes 4 passes by the electrode 4 of another leg, since they do not come in contact with the leg, a short-circuit or pressure deterioration can be prevented.

EXAMPLES

Example 1

According to Example 1, evaluations were made on 15 kinds of samples provided such that sintered bodies of original forms of the ferrite porcelain which were manufactured in the same conditions were processed by a barreling process so that the tapered shapes of the legs 2 and the curved-surface shapes of the vertical corner portions of the legs 2 might be different from each other. The tapered shapes of the legs 2 and the curved surface shapes of the vertical corner portions were varied by adjusting an amount of polishing agent, the number of sintered bodies to be processed and a processing time.

According to Example 1, an Ni—Zn ferrite material as a magnetic material and a binder were mixed and raw powder was manufactured by spray drying.

Then, this raw powder was molded so as to provide the original form of the ferrite core 6 of the present invention as shown in FIGS. 1A and 1B by powder-press molding, and then burned at 900 to 1300° C. to manufacture many sintered bodies of the original forms of the ferrite porcelains each having four legs 2.

The sintered bodies were processed by a barreling device comprising a barrel-shaped pot (container) formed of porcelain, by varying processing conditions to manufacture 15 kinds of samples having different shapes depending on the processing conditions.

Here, as the polishing agent, there were prepared one to which alumina whose resistance value was $10^{11}$ Ω·cm and grain diameter was 80 μm and water were added, and one to which silicon carbide whose resistance value was $10^{4}$ Ω·cm and grain diameter was 80 μm and water were added. The resistance value of the polishing agent was measured by a high-resistance measuring device produced by HP Co. such that a DC voltage of 50 V was applied to the polishing agent which was put in an insulating mold and pressed to be hardened. According to Example 1, the 15 kinds of samples (sample No. 1 to 15) having different shapes of the legs shown in Table 1 were manufactured by using either one of the above two kinds of polishing agents and varying the conditions of the barreling process so as to vary the shapes of the legs 2.

In addition, according to Example 1, each ferrite porcelain has a 2012 size of a rectangular in which 2.0 mm by 1.2 mm when mounted (a top surface of each leg 2 is 0.4×0.4 mm, distances between the legs 2*a* and 2*b* at the bottom, and between legs 2*c* and 2*d* at the bottom is 0.4 mm, and a length between the bottom of the leg 2 and the wound core 4 is 0.25 mm). In addition, the leg 2 was tapered off such that the area of the top surface is 70% of the sectional area at the boundary with the flange 1.

In addition, as comparative examples, a sample in which the barreling process was not performed and samples in which the leg 2 had the same sectional area from the side of the flange to the side of the top surface were prepared (sample No. 16 to 18).

In addition, according to Example 1, the electrodes 3 were formed on all of the ferrite porcelain samples and 30 ferrite core samples are manufactured for each sample No. The electrode 3 was formed such that an Ag paste was applied to each leg 2 of the ferrite porcelain sample by dipping and the thick film conductor was printed and burned, and after the thick film conductor was burned onto the ferrite porcelain, Ni and Sn were formed on the thick film conductor by electric field plating.

According to the thickness of the electrode 3, Ag was 20 μm, Ni was 2 μm and Sn was 7 μm and a dimension of the leg 2 of the Ag thick film conductor from the top surface to the wound core 4 was 0.1 mm. In addition, the shape of the leg 2 of each ferrite core sample was measured by a measuring microscope.

Then, each ferrite core sample was evaluated by the following method.

(1) Elongation of each plating was evaluated. The elongation of the plating shown in FIG. 5 from the top surface of the leg 2 of the Ag thick film conductor as an upper leading edge toward the wound core was measured by the measuring microscope and an average of the elongation of the plating of the four legs 2 was calculated.

(2) Insulation resistance between electrodes 3*a* and 3*b* when a DC 50 V was applied to the electrodes 3*a* and 3*b* of each ferrite core sample through respective probes was evaluated. The measuring device used here is a high-resistance measuring device produced by HP Co., and the measuring voltage of 50 V is an inductor which is generally used in evaluating the insulation resistance between conductors or the conductor wire and the ferrite core and the like.

(3) Each ferrite core sample was soldered on a mounting substrate using the electrode 3 on the top surface of the leg 2, the substrate on which the ferrite core sample was mounted was fixed on a test stand produced by AIKOH Co. using a two-sided tape, and the wound core 4 at the side of 2.0 mm of a rectangular size of the mounted ferrite core 6 when mounted was pressed by a penetrator in the direction parallel to the mounting substrate at a speed of 5 mm/minute using the CPU GAGE produced by AIKOH Co. Thus, strength when all of the legs 2 were broken and the ferrite core sample was separated from the mounting substrate was evaluated.

(4) 30 ferrite core samples were prepared, respectively and a conductor wire of 0.1 mm in diameter was wounded around each ferrite core by 7 turns, a tip end of the conductor wire was put in a soldering bath to be conductive, respective Q values (loss characteristics) were measured by the LCR meter produced by HP Co. at a measurement frequency of 1 MHz and at a measurement voltage of 50 mV, and standard deviation which was variation of 30 Q values was calculated.

TABLE 1

| | Shape of leg | | | Processing | | Evaluation | | | | |
|---|---|---|---|---|---|---|---|---|---|---|
| Sample No. | Shape | Curvature radius on flange side (mm) | Curvature radius on top surface side (mm) | Method | Polishing agent | Growth of plating (mm) | Insulation resistance (Ω · cm) | Strength (N) | Average of Q values | Variation |
| 1 | Tapered | 0.01 | 0.01 | Barreling | Alumina | 0.15 | $10^{7}$ | 37 | 10.4 | 1.8 |
| 2 | Uniform R | 0.02 | 0.02 | process | | 0.1 | $10^{8}$ | 35 | 11 | 1.71 |
| 3 | | 0.06 | 0.06 | | | 0.08 | $10^{10}$ | 30 | 11.8 | 1.5 |

TABLE 1-continued

| | Shape of leg | | | | | Evaluation | | | | |
|---|---|---|---|---|---|---|---|---|---|---|
| | | Curvature radius on | Curvature radius on | Processing | | Growth of | Insulation | | | |
| Sample No. | Shape | flange side (mm) | top surface side (mm) | Method | Polishing agent | plating (mm) | resistance (Ω · cm) | Strength (N) | Average of Q values | Variation |
| 4 | | 0.1 | 0.1 | | | 0.07 | $10^{11}$ | 24 | 12.2 | 1.37 |
| 5 | | 0.15 | 0.15 | | | 0.05 | $10^{11}$ | 18 | 12.7 | 1.35 |
| 6 | | 0.2 | 0.02 | | | 0.02 | $10^{11}$ | 11 | 13 | 1.22 |
| 7 | | 0.22 | 0.2 | | | 0.02 | $10^{11}$ | 10 | 13.1 | 1.27 |
| 8 | | 0.06 | 0.06 | | Silicon carbide | 0.15 | $10^{7}$ | 29 | 10.8 | 1.8 |
| 9 | Tapered | 0 | 0.05 | Barreling process | Alumina | 0.09 | $10^{10}$ | 37 | 12 | 1.6 |
| 10 | Increased | 0.02 | 0.05 | | | 0.08 | $10^{10}$ | 33 | 11.9 | 1.6 |
| 11 | R | 0.06 | 0.1 | | | 0.06 | $10^{11}$ | 28 | 12.3 | 1.4 |
| 12 | | 0.1 | 0.15 | | | 0.05 | $10^{11}$ | 24 | 12.6 | 1.35 |
| 13 | | 0.15 | 0.2 | | | 0.02 | $10^{11}$ | 15 | 13.1 | 1.26 |
| 14 | | 0.2 | 0.22 | | | 0.02 | $10^{11}$ | 10 | 13.2 | 1.26 |
| 15 | | 0.06 | 0.1 | | Silicon carbide | 0.14 | $10^{7}$ | 26 | 10.6 | 1.77 |
| *16 | Tapered | 0 | 0 | — | — | 0.23 | $10^{5}$ | 40 | 9.7 | 2 |
| *17 | Straight | 0 | 0 | — | — | 0.25 | $10^{5}$ | 42 | 9.5 | 2.3 |
| *18 | Straight | 0.1 | 0.1 | Barreling process | Alumina | 0.2 | $10^{6}$ | 35 | 10.2 | 2.3 |

The sample to which * is allotted are out of scope of claims.

As can be seen from Table 1, according to the samples (No. 1 to 15) in which each leg 2 was tapered off to the top surface and the vertical corner portion between the side faces of the each leg had a curved surface, the elongation of plating was as small as 0.16 mm or less, the insulation resistance between legs 2 was kept at $10^7$ Ω·cm or more and the strength was 10N or more. In addition, the averaged Q value in the ferrite core sample was as high as 10.4 or more and its variation was as low as 1.8 or less.

Especially, according to the samples (No. 2 to 6) in which barreling process was performed and the curvature radius of the vertical corner portion of each leg 2 was 0.02 to 0.2 mm, and according to the samples (No. 10 to 13) in which the curvature radius of the vertical corner portion of each leg 2 was 0.02 to 0.15 mm on the side of the flange and 0.05 to 0.2 mm on the side of the top surface, the plating elongation could be as small as 1 mm or less, the insulation resistance between the legs 2 could be sufficiently kept at $10^8$ Ω·cm or more, and the Q value was 11 or more and its variation was as low as 1.71 or less. This is considered such that since each leg was tapered off and the vertical corner portion had the curved surface, the elongation of the plating was prevented and the area of the electrode 3 having low Q value was decreased, so that the Q value as the ferrite core 6 was increased. In addition, it is considered such that when the elongation of the plating was prevented, since the dimension of the electrode 3 became stable, the variation of Q values became small.

Meanwhile, according to the samples (No. 16 and 17) of the comparative examples in which barreling process was not performed and the edge line of the leg 2 had a corner, the elongation of plating was as long as 0.23 mm or more, the insulation resistance between the legs is as small as $10^5$ Ω·cm, and Q value is 9.7 or less and its variation is as large as 2 or more.

In addition, according to the sample (No. 18) in which the vertical corner portion of the leg 2 had a curved surface but the leg was not tapered off, the elongation of the plating was large, the insulation resistance between legs 2 was $10^6$ Ω·cm, the Q values was 10.2, and its variation was as large as 2.3, as compared with the sample (No. 4) in which the curvature radius was the same as the above and the leg was tapered off. This means that when the leg 2 was tapered off and the vertical corner portion of the leg had the curved surface, the electric charges were prevented from converging at the vertical corner portion of the leg 2 so that the elongation of the plating was prevented.

Example 2

According to Example 2, except that only water was used as the polishing agent, similar to Example 1, the barreling process were performed under the various conditions and a leg 2 was formed into the shape shown in Table 2 and an electrode 3 was formed on a top surface thereof.

In addition, the shape of the leg 2 of each ferrite core sample was measured by a measuring microscope.

Then, similar to Example 1, the evaluations (1) to (3) were made for each ferrite core sample provided.

Besides, 30 ferrite cores were prepared for each sample No. and a conductor wire having a diameter of 0.1 mm were wound by 7 turns and the evaluation (4) was made similar to Example 1.

In addition, 30 ferrite cores were prepared for each sample No. and a conductor wire of 0.1 mm in diameter was wound around the ferrite core and the evaluation (4) was made similar to Example 1.

Their results are shown in Table 2.

Table 2

| Sample No. | Shape of leg: Shape | Shape of leg: Curvature radius on flange side (mm) | Shape of leg: Curvature radius on top surface side (mm) | Processing: Method | Processing: Polishing agent | Evaluation: Growth of plating (mm) | Evaluation: Insulation resistance (Ω · cm) | Evaluation: Strength (N) | Evaluation: Average of Q values | Evaluation: Variation |
|---|---|---|---|---|---|---|---|---|---|---|
| 19 | Tapered | 0.01 | 0.01 | Barreling | Water | 0.16 | $10^7$ | 36 | 10.2 | 1.9 |
| 20 | Uniform R | 0.02 | 0.02 | process | | 0.09 | $10^8$ | 33 | 11.2 | 1.75 |
| 21 | | 0.06 | 0.06 | | | 0.08 | $10^{10}$ | 29 | 11.9 | 1.47 |
| 22 | | 0.1 | 0.1 | | | 0.07 | $10^{11}$ | 25 | 12.5 | 1.39 |
| 23 | | 0.15 | 0.15 | | | 0.04 | $10^{11}$ | 20 | 12.9 | 1.33 |
| 24 | | 0.2 | 0.2 | | | 0.02 | $10^{11}$ | 11 | 13 | 1.26 |
| 25 | | 0.22 | 0.22 | | | 0.01 | $10^{11}$ | 8 | 13.1 | 1.25 |
| 26 | Tapered | 0 | 0.05 | Barreling | Water | 0.1 | $10^{10}$ | 38 | 11.7 | 1.6 |
| 27 | Increased | 0.02 | 0.05 | process | | 0.07 | $10^{10}$ | 32 | 12 | 1.6 |
| 28 | R | 0.06 | 0.1 | | | 0.05 | $10^{11}$ | 29 | 12.5 | 1.37 |
| 29 | | 0.1 | 0.15 | | | 0.04 | $10^{11}$ | 26 | 12.6 | 1.32 |
| 30 | | 0.15 | 0.2 | | | 0.02 | $10^{11}$ | 27 | 12.3 | 1.26 |
| 31 | | 0.2 | 0.22 | | | 0.02 | $10^{11}$ | 9 | 13.2 | 1.27 |

As can be seen from the table 2, according to the samples (No. 19 to 31) in which each leg 2 was tapered off to the top surface and the vertical corner portion between the side faces of the each leg had a curved surface, the elongation of plating was as small as 0.16 mm or less, the insulation resistance between legs 2 was kept at $10^7$ Ω·cm or more and the strength was 8N or more. In addition, the averaged Q value in the ferrite core sample was as high as 10.2 or more and its variation was as low as 1.9 or less.

Especially, according to the samples (No. 20 to 24) in which the curvature radius of the vertical corner portion of each leg 2 was 0.02 to 0.2 mm, and according to the samples (No. 27 to 30) in which the curvature radius of the vertical corner portion of each leg 2 was 0.02 to 0.15 mm on the side of the flange and 0.05 to 0.2 mm on the side of the top surface, the plating elongation could be as small as 0.09 mm or less, the insulation resistance between the legs 2 can be sufficiently kept at $10^8$ Ω·cm or more, and the strength was 11N or more. In addition, the Q value was 11 or more and its variation was as low as 1.75 or less. This is considered such that since each leg was tapered off and the vertical corner portion had the curved surface, the elongation of the plating was prevented and the area of the electrode 3 having low Q value was decreased, so that the Q value as the ferrite core 6 was increased. In addition, it is considered such that when the elongation of the plating was prevented, since the dimension of the electrode 3 became stable, the variation of the Q value became small.

Meanwhile, according to the sample (No. 25) of the comparative example in which the curvature radius of the vertical corner portion was 0.22 mm, and according to the sample (No. 31) of the comparative example in which the curvature radius of the vertical corner portion of each leg 2 was 0.2 mm on the side of the flange and 0.22 mm on the side of the top surface, the plating elongation was 0.02 mm or less, the insulation resistance between legs 2 was as high as $10^{11}$ Ω·cm, and the Q value was 13 or more and its variation was 1.27 or less but the strength was as small as 9N or less.

This means that the sectional area of the leg 2 was decreased by increasing the curved body of the vertical corner portion of each leg 2, so that the strength of the leg 2 was lowered.

Example 3

According to Example 3, the ferrite core 56 of the present invention shown in FIG. 8 is manufactured.

First, Ni—Zn ferrite as a magnetic material and a binder were mixed and raw powder was manufactured by spray drying.

Then, a die divided into a wound core 5 and legs 52*a* to 52*c* and 62*a* to 62*c* was manufactured and after it was set in a powder-press molding machine, the raw power was put therein and molded.

Then, it was burned at 900 to 1300° C. to manufacture a sintered body of the original form of the ferrite porcelain having four legs 52*a*, 52*c*, 62*a* and 62*c*. Thus, 20 sintered bodies were manufactured.

At this time, maximum lengths of the legs 52*a*, 52*c*, 62*a* and 62*c* were set as follows.

The maximum length of the legs 52*c* and 62*a*: 0.4 mm

The maximum length of the legs 52*a* and 62*c*: 0.3 mm.

Then, the sintered bodies were put in the barreling device having a barrel-shaped container formed of a ferrite porcelain and the barreling process was performed for processing the surface and removing molding flash, to provide a ferrite porcelain.

Then, electrodes 4 were formed on all of the ferrite porcelains and 20 ferrite core samples were provided for each sample No. The electrode 4 was formed such that an Ag paste was applied to each of the legs 52*a*, 52*c*, 62*a* and 62*c* of the ferrite porcelain by dipping and burned so that the thick film conductor was burned onto the ferrite porcelain, Ni and Sn were formed on the thick film conductor by electric field plating.

According to the thickness of the electrode 4, Ag was 20 μm, Ni was 2 μm and Sn was 7 μm and a dimension of each of the legs 52*a*, 52*c*, 62*a* and 62*c* of the Ag thick film conductor from the top surface to the wound core 5 was 0.1 mm.

Then, each ferrite core sample was evaluated by the following method.

(1) 20 ferrite core samples were prepared, respectively. A conductor wire 7 of 0.1 mm in diameter was wound around each sample by 7 turns and ends of the conductor wire 7 were connected to the legs 52*a*, 52*c*, 62*a* and 62*c* by soldering. Then, it was confirmed whether the conductor wire 7 was in touch with the legs 52*a*, 52*c*, 62*a* and 62*c*, which were to be separated from each other, by a binocular microscope.

(2) A conductive state of each of the 20 ferrite core samples confirmed at the evaluation (1) was confirmed whether the pairs of legs 52*a* and 62*c*, and 52*c* and 62*a* short-circuit with other legs, by a high-resistance meter DT-110 produced by HOZAN Co.

That is, it was confirmed whether the leg 62*a* was connected to the leg 52*a* or not.

(3) Each ferrite core sample was soldered on a mounting substrate using the electrodes 4 on the top surfaces of the legs 52*a*, 52*c*, 62*a* and 62*c*, and bonding strength to the mounting substrate was evaluated. More specifically, the substrate on which the ferrite core sample was mounted was fixed on a test stand produced by AIKOH Co. using a two-sided tape, and the wound core 5 at the side of 2.0 mm of a rectangular size of the mounted ferrite core 56 when mounted was pressed by a penetrator in the direction parallel to the mounting substrate at a speed of 5 mm/minute using the CPU GAGE produced by AIKOH Co.

Thus, strength when all of the legs 52*a*, 52*c*, 62*a* and 62*c* were broken and the ferrite core was separated from the mounting substrate was evaluated.

The results are shown in Table 3

TABLE 3

| Sample No. | Contact with leg | Short-circuit | Adhesion strength |
|---|---|---|---|
| 1 | No | No | 9 N |
| 2 | No | No | 9 N |
| 3 | No | No | 10 N |
| 4 | No | No | 9 N |
| 5 | No | No | 8 N |
| 6 | No | No | 10 N |
| 7 | No | No | 9 N |
| 8 | No | No | 9 N |
| 9 | No | No | 8 N |
| 10 | No | No | 10 N |
| 11 | No | No | 9 N |
| 12 | No | No | 10 N |
| 13 | No | No | 9 N |
| 14 | No | No | 9 N |
| 15 | No | No | 8 N |
| 16 | No | No | 10 N |
| 17 | No | No | 10 N |
| 18 | No | No | 9 N |
| 19 | No | No | 9 N |
| 20 | No | No | 8 N |
| | Averaged adhesion strength | | 9.1 N |

As can be seen from Table 3, since there was no contact between the conductor wire 7 and each of the legs 52*a*, 52*c*, 62*a* and 62*c*, it was shown that measures for pressure deterioration have been taken.

In addition, there is no problem of the short-circuit caused by the contact between the conductor wire 7 and the electrode 4.

According to the adhesion strength, it was about the same as in the conventional one.

As described above, as shown in FIG. 8, it was proved that the problems such as short-circuit, pressure deterioration and the like could be solved by varying the maximum length of the legs 52*a*, 52*c*, 62*a* and 62*c*.

Example 4

According to Example 4, the ferrite core 206 of the present invention shown in FIG. 11B is manufactured.

Here, Ni—Zn ferrite as a magnetic material and a binder were mixed and raw powder was manufactured by spray drying. Then, a die divided into a wound core 5 and legs 202*a*, 202*c*, 212*a* and 212*c* was manufactured and after it was set in a powder-press molding machine, the raw power was put therein and molded.

Then, it was burned at 900 to 1300° C. to manufacture a sintered body which would become the ferrite porcelain having four legs 202*a*, 202*c*, 212*a* and 212*c*. Thus, 20 sintered bodies were manufactured.

At this time, the maximum length of each of long axes of the legs 202*a*, 202*c*, 212*a* and 212*c* were set at 0.4 mm.

Then, the sintered bodes were put in the barreling device having a barrel-shaped container formed of a ferrite porcelain and the barreling process was performed for processing the surface and removing molding flash, to provide ferrite porcelains.

Then, electrodes 4 were formed on all of the ferrite porcelains and 20 ferrite core samples were provided for each sample No. The electrode 4 was formed such that an Ag paste was applied to each of the legs 202*a*, 202*c*, 212*a* and 212*c* of the ferrite porcelain by dipping and burned so that the thick film conductor was burned into the ferrite porcelain, and Ni and Sn were formed on the thick film conductor by electric field plating.

According to the thickness of the electrode 4, Ag was 20 μm, Ni was 2 μm and Sn was 7 μm and a dimension of each of the legs 2*a*, 2*c*, 12*a* and 12*c* of the Ag thick film conductor from the top surface to the wound core 5 was 0.1 mm.

Then, each ferrite core sample was evaluated by the same methods as in Example 3.

The results are shown in Table 4.

TABLE 4

| Sample No. | Contact with leg | Short-circuit | Adhesion strength |
|---|---|---|---|
| 1 | No | No | 12 N |
| 2 | No | No | 11 N |
| 3 | No | No | 12 N |
| 4 | No | No | 13 N |
| 5 | No | No | 13 N |
| 6 | No | No | 14 N |
| 7 | No | No | 13 N |
| 8 | No | No | 13 N |
| 9 | No | No | 13 N |
| 10 | No | No | 13 N |
| 11 | No | No | 14 N |
| 12 | No | No | 13 N |
| 13 | No | No | 13 N |
| 14 | No | No | 15 N |
| 15 | No | No | 13 N |
| 16 | No | No | 13 N |
| 17 | No | No | 14 N |
| 18 | No | No | 13 N |
| 19 | No | No | 13 N |
| 20 | No | No | 12 N |
| | Averaged adhesion strength | | 13.0 N |

As can be seen from the table 4, since there was no contact between the conductor wire 7 and each of the legs 202*a*, 202*c*, 212*a* and 212*c*, it was shown that measures for pressure deterioration have been taken.

In addition, there was no problem of the short-circuit caused by the contact between the conductor wire 7 and the electrode 4.

The adhesion strength was improved to be 13.0N in FIG. 11, while it was 9.1N in FIG. 8.

As described above, it was proved that the problems such as short-circuit, pressure deterioration and the like could be solved by varying the angles of the legs 202*a*, 202*c*, 212*a* and 212*c*.

What is claimed is:

1. A ferrite core comprising:

a wound core; and flanges integrally formed at both ends of said wound core, each of said flanges including a plurality of legs formed so as to rise from one surface of said wound core, each of said legs having a top surface to be formed with an electrode, wherein each of said legs is tapered off toward said top surface and each of corner portions is rounded, wherein at least a portion of each vertical edge of said legs is rounded.

2. The ferrite core according to claim 1, wherein a curvature radius of said each corner portion of said legs is set in a range of 0.02 to 0.2 mm.

3. The ferrite core according to claim 1, wherein a curvature radius of said each corner portion of said legs is gradually increased toward said top surface so that the curvature radius is set in a range of 0.02 to 0.15 mm on the side of said one surface and the curvature radius is set in a range of 0.05 to 0.2 mm on the side of said top surface.

4. A method of manufacturing a ferrite core comprising a wound core, and flanges integrally formed at both ends of the wound core, each of said flanges including a plurality of legs formed so as to rise from one surface of said wound core, said each of said legs having a top surface to be formed with electrode, wherein each of said legs is tapered off toward said top surface and each of corner portions is rounded, wherein at least a portion of each vertical edge of said legs is rounded, the method comprising a step of chamfering corner portions of each of said legs so as to have a curved surface by processing a sintered body which is an original form of the ferrite core by a barreling process.

5. The method according to claim 4, wherein water is used in the barreling process.

6. The method according to claim 5, wherein a polishing agent having resistance of $10^5$ Ω·cm or more is used in the barreling process.

7. A common-mode noise filter, wherein a conductor wire is wound around the ferrite core according to claim 1.

* * * * *